US007775398B2

(12) United States Patent
Py et al.

(10) Patent No.: US 7,775,398 B2
(45) Date of Patent: Aug. 17, 2010

(54) CONTAINER AND ONE-WAY VALVE ASSEMBLY FOR STORING AND DISPENSING SUBSTANCES, AND RELATED METHOD

(75) Inventors: Daniel Py, Larchmont, NY (US); Miles J. Flamenbaum, Bedford, NY (US); Eric E. Hartman, Ridgefield, CT (US); Nathaniel Houle, Hebron, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 877 days.

(21) Appl. No.: 11/588,968

(22) Filed: Oct. 26, 2006

(65) Prior Publication Data

US 2007/0095857 A1 May 3, 2007

Related U.S. Application Data

(60) Provisional application No. 60/730,520, filed on Oct. 26, 2005.

(51) Int. Cl.
*B67D 1/00* (2006.01)

(52) U.S. Cl. ..... 222/91; 222/81; 222/83; 222/83.5; 222/153.06; 222/153.07; 222/541.2; 222/541.9

(58) Field of Classification Search ..... 222/91, 222/80–81, 1, 83, 83.5, 88, 490, 494, 519, 222/520, 525, 212–215, 153.05, 153.06, 222/153.07, 541.1, 541.2, 541.9
See application file for complete search history.

(56) References Cited

U.S. PATENT DOCUMENTS 2,585,253 A * 2/1952 Kochner ..... 222/5
4,696,415 A * 9/1987 Meshberg ..... 222/82
4,706,827 A * 11/1987 Cabernoch et al. ..... 215/11.3
5,310,094 A * 5/1994 Martinez et al. ..... 222/212
5,746,728 A 5/1998 Py
5,944,702 A 8/1999 Py
6,032,101 A 2/2000 Freeman et al.
6,045,004 A * 4/2000 Elliott ..... 222/83
RE37,047 E 2/2001 Py
6,659,308 B1 * 12/2003 Kelder et al. ..... 222/83

(Continued)

OTHER PUBLICATIONS

International Search Report and Written Opinion of the International Searching Authority for International Application No. PCT/US06/042159.

*Primary Examiner*—Frederick C. Nicolas
(74) *Attorney, Agent, or Firm*—McCarter & English, LLP

(57) ABSTRACT

A device for storing and dispensing a substance includes a storage chamber for the substance. The container includes a passageway in fluid communication with the storage chamber. The container includes a pierceable wall located on an opposite side of the passageway relative to the storage chamber. The device includes a one-way valve assembly including a piercing portion. At least one of the piercing portion and the pierceable wall is movable relative to the other between a first position wherein the pierceable portion is not piercing the pierceable wall, and a second position wherein the pierceable portion is piercing the pierceable wall allowing the flow of substance from the storage chamber. A removable member is disposed intermediate the valve and the container that prevents movement of at least one of the piercing portion and pierceable wall to the second position until the removable member is removed.

15 Claims, 20 Drawing Sheets

U.S. PATENT DOCUMENTS 7,114,635 B2 * 10/2006 Yamada ..... 222/83
2002/0017294 A1 2/2002 Py
2002/0074362 A1 6/2002 Py et al.
2003/0106911 A1 6/2003 Adams et al.
2005/0121477 A1 6/2005 Scott

* cited by examiner

CONTAINER AND ONE-WAY VALVE ASSEMBLY FOR STORING AND DISPENSING SUBSTANCES, AND RELATED METHOD

CROSS-REFERENCE TO RELATED APPLICATION

This application claims priority on U.S. Provisional Application No. 60/730,520, filed Oct. 26, 2005, entitled "Container and One-Way Valve Assembly for Storing and Dispensing Substances, and Related Method, which is hereby expressly incorporated by reference as part of the present disclosure.

FIELD OF THE INVENTION

The invention relates to valves, containers and other apparatus and related method for storing and dispensing substances, such as creamy, liquid, or pasty substances.

BACKGROUND OF THE INVENTION

Flexible tubes are used to store a variety of powder, liquid, gel, creamy and pasty products having a broad range of viscosities. Generally, the flexible tubes have a cover which is removed to expose a simple release aperture. As a result, low pressure is required to express the contents therein. Undesirable oozing and collection of product that can clog the release aperture is common. Many such prior art dispensers expose the bulk product contained within the dispenser after opening to air, and may expose the bulk product to impurities or other undesirable matter during and/or after application of the product, thereby affecting the integrity of the product remaining in the dispenser and spreading of these impurities with subsequent use of the product or otherwise degrading the product between usages. Moreover, when the traditional tube is opened, the contents are not only subject to the environment but a quantity of air is normally sucked into the tube. For example, many products such as liquid lipstick are particularly poorly suited for dispensing by prior art containers. The liquid lipstick or other product becomes contaminated, evaporates due to air passage losing moisture, and ultimately is unusable if not unsafe before complete utilization of the product. The tips become contaminated, dirty and sticky or crusty as well as allowing the lipstick or other product to continue to flow when not being used.

Similarly, many prescription and OTC pharmaceutical products, such as antibiotic ointments, are commonly packaged in a flexible tube that is sealed with a pierceable foil proximate the release aperture and a cover that includes a piercing member for piercing the pierceable foil sealing the antibiotic ointment or other product within the tube. The cover is removed from the tube and rotated to align the piercing member with the pierceable foil seal. The piercing member is then pushed into the foil seal to penetrate the same to allow the ointment to be dispensed from the tube. Commonly however, the ointment undesirably oozes out of the release aperture upon penetrating the foil seal and the piercing member becomes coated with ointment, thus wasting a portion of the ointment. Furthermore, the tube does not serve well as an applicator and excess ointment must be wiped from the release aperture before the cover is replaced, adding to waste of the ointment.

In view of the above, one solution has been to provide products in smaller, portable quantities, such as individual use foil or plastic packets. However, the increased packaging costs associated with these packets undesirably increases the overall price of the product paid by the consumer.

Moreover, certain types of products, such as those that require regulatory approval, may require approval of the product's container. Thus, it is desirable if the containers for currently existing products would remain substantially the same so that additional testing and approvals would not be required as would be the case for a new container.

In view of the above, several containers have been provided with closure devices such as one-way valves. One drawback associated with prior art dispensers including one-way valves is that the valves are frequently designed to work with mechanical pumps or like actuators that are capable of creating relatively high valve opening pressures. Exemplary dispensers of this type are illustrated in U.S. Pat. Nos. RE 37,047, 6,032,101, 5,944,702, and 5,746,728 and U.S. Publication Nos. US2002/0074362 A1, US2002/0017294 A1. Squeeze tube-type dispensers, on the other hand, are not capable of creating the necessary valve opening pressures, and therefore such prior art valves do not work effectively with squeeze tubes.

Accordingly, it is an object of the present invention is to overcome one or more of the above-described drawbacks and disadvantages of the prior art.

SUMMARY OF THE INVENTION

According to a first aspect the present invention is directed to a device for storing and dispensing a substance including a container having a body defining therein a storage chamber for receiving and storing the substance. There is a first passageway that is in fluid communication with the storage chamber of the body and that defines a flow path therebetween. The container includes a pierceable wall located on an opposite side of the passageway relative to the storage chamber, and a first connecting portion located at one end of the body for connecting another component thereto.

The device further includes a one-way valve assembly that includes a valve body having a body base defining a second passageway, and a piercing portion engageable with the pierceable wall of the container. At least one of the piercing portion of the valve assembly and the pierceable wall of the container is movable relative to the other between a first position wherein the pierceable portion is not piercing the pierceable wall, and a second position wherein the pierceable portion is piercing the pierceable wall and the first passageway of the container is in fluid communication with the second passageway of the valve body for allowing the flow of substance from the storage chamber therethrough. The valve assembly also includes a second connecting portion that is connectable to the first connecting portion of the container for fixedly securing the valve assembly to the container when the valve assembly and container are located in the second position. The valve body also includes a removable member intermediate the valve body and the container to prevent movement of the piercing portion and pierceable wall to the second position. When a user desires to dispense a product, the removable member may be manually engaged and removed to, in turn, allow at least one of the piercing portion of the valve assembly and the pierceable wall of the container to be moved from the first to the second position for dispensing product from the storage chamber through the valve assembly.

In accordance with another aspect, the valve assembly further includes a valve seat and at least one flow aperture extending through the valve body adjacent to the valve seat and in fluid communication with the second passageway for receiving the substance from the storage chamber therethrough. The valve assembly also includes a valve cover including a cover base mounted on the body base and fixedly secured against axial movement relative thereto. A valve portion overlies the valve seat. In one embodiment with the invention, the valve portion defines a predetermined radial thickness and a diameter less than a diameter of the valve seat to thereby form an interference fit therebetween.

In accordance with another aspect, the present invention is directed to a device for storing and dispensing a substance. The device includes a container comprising a flexible body defining therein a storage chamber for receiving and storing the substance, a first axially-extending passageway that is coupled in fluid communication with the storage chamber of the flexible body and defines an unobstructed axially-extending flow path therebetween, a pierceable wall located on an opposite side of the passageway relative to the storage chamber, and a first connecting portion located at one end of the flexible body for connecting another component thereto. The device further includes a one-way valve assembly that includes a valve body having a body base defining a second axially-extending passageway and a separate piercing portion connected to the valve body and engageable with the pierceable wall of the container At least one of the piercing portion of the valve assembly and the pierceable wall of the container is movable relative to the other between a first position wherein the piercing portion is not piercing the pierceable wall, and a second position wherein the pierceable portion is piercing the pierceable wall such that the first passageway of the container is in fluid communication with the second passageway of the valve body for allowing the flow of substance from the storage chamber therethrough. The one-way valve assembly also includes a second connecting portion that is connectable to the first connecting portion of the container for fixedly securing the valve assembly to the container when the valve assembly and container are engaged.

In a currently preferred embodiment of the present invention, the first and second connecting portions are threaded for threadedly engaging each other. The one-way valve assembly further includes an axially-extending valve seat, and at least one flow aperture axially extending through the valve body adjacent to the valve seat and coupled in fluid communication with the second axially-extending passageway for receiving the substance from the storage chamber therethrough. The one-way valve assembly also includes a valve cover formed of an elastic material and including a cover base mounted on the body base and fixedly secured against axial movement relative thereto, and a valve portion overlying the valve seat. The valve portion defines a predetermined radial thickness and a diameter less than a diameter of the valve seat to thereby form an interference fit therebetween. The valve portion and the valve seat define a normally closed, annular, axially-extending valve opening therebetween, and the valve portion is movable radially between abnormally closed position with the valve portion engaging the valve seat, and an open position with at least a segment of the valve portion spaced radially away from the valve seat to allow the passage of substance therebetween.

In accordance with another aspect, the present invention is directed to a device for storing and dispensing a substance comprising first means for storing a substance and including a pierceable wall, and second means assembled to the first means for dispensing the substance and preventing the substance from flowing therethrough in a direction opposite the dispensing direction. The device further includes third means for piercing the pierceable wall and disposed on the second means, and fourth means for preventing the third means from piercing the pierceable wall until desired to do so. At least one of the first means and the second means is movable relative to the other between a first position in which the third means is not piercing the pierceable wall, and a second position in which the third means is piercing the pierceable wall and the first means and the second means are in fluid communication with each other for allowing dispensing of product through the second means.

Another aspect of the present invention is directed to a method that includes providing a one-way valve assembly having a piercing member and a container having a pierceable wall. The method further includes engaging the valve assembly to the container, such as by threaded engagement, so that the valve assembly and the container are located in a first position without the piercing member piercing the pierceable wall, moving at least one of the valve assembly and the container relative to the other to a second position and, in turn, piercing the pierceable wall with the pierceable member in the second position so that the valve assembly and an interior of the container are in fluid communication with each other.

One advantage of the present invention is that each device includes a one-way valve assembly that is movably mounted onto a container, such as a squeeze tube-type container, that may be the same as any of numerous containers already in use and thus regulatory approved. The one-way valve assembly includes a piercing portion that pierces a pierceable wall of the container and provides fluid communication of the substance with the one-way valve without having to remove the piercing portion and/or wipe excess substance therefrom after piercing the pierceable wall. The one-way valve assembly limits the substance therein to exposure with the environment including preventing ambient air from being sucked into the container, thus limiting degradation of the substance between usages. The one-way valve also allows dispensing of the substance from a squeeze tube-type container by squeezing the tube to dispense the substance out of the one-way valve assembly while inherently maintaining a dispensing portion of the valve relatively clean and clog free after dispensing and thereby preventing or limiting waste of the substance.

Other objects and advantages of the device and method of the present invention will become readily apparent in view of the following detailed description of the currently preferred embodiments and accompanying drawings.

DETAILED DESCRIPTION OF THE PREFERRED EMBODIMENTS

Figure 1:
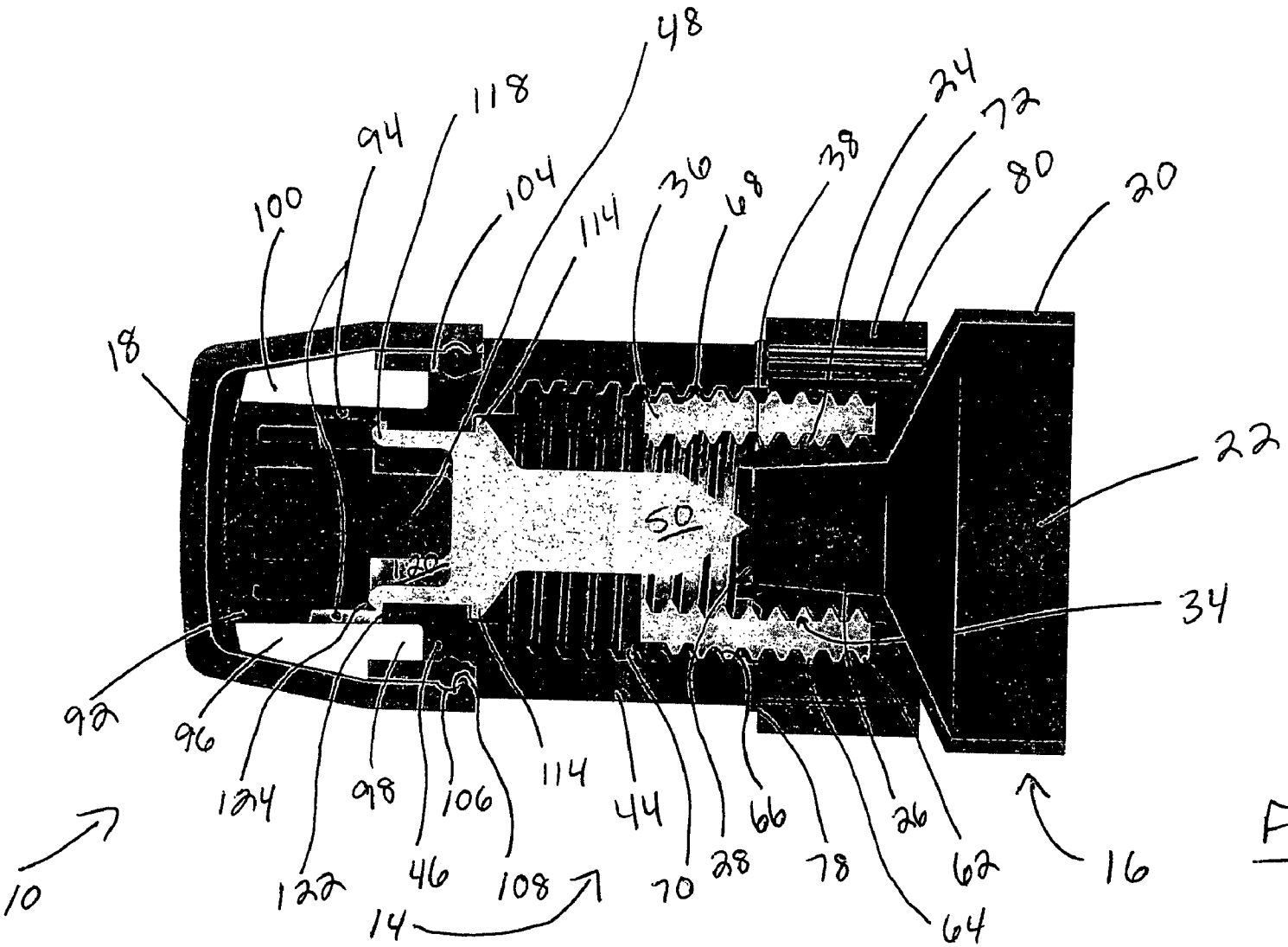
FIG. 1 is a partial cross-sectional view of a device including a container, a cap and one-way valve assembly that is connectable to the container for piercing the container and dispensing substances therefrom.

Referring to FIGS. 1-4, a device including a one-way valve assembly and container embodying the present invention is indicated generally by the reference numeral 10. The device 10 includes a one-way valve assembly 14 that is connectable in fluid communication with a container 16. While the exemplary embodiments illustrate a tubular container, it is understood that any of numerous other container shapes or configurations that are currently known or that later become known equally may be used. A cap 18 is releasably connected to the valve assembly 14 for covering the valve assembly when not in use.

The container 16 comprises a body 20 defining therein a storage chamber 22 for receiving and storing a substance. The substance includes products that are creamy, pasty, liquid, or other such substance. In an exemplary embodiment, the substance includes any of numerous different types of cosmetics, such as eye and lip treatments, including, for example, lip gloss, eye colors, eye glaze, eye shadow, lip color, moisturizers and make-up, such as cover-up, concealer, shine control, mattifying make-up, and line minimizing make-up, personal care items such as lotions, creams and ointments, oral care items such as toothpaste, mouth washes and/or fresheners, pharmaceutical products such as prescription and over-the-counter drugs, including for example antibiotic ointments, dermatological products, such as products for treating skin abrasions and lacerations (e.g., an antibiotic ointment and/or external analgesic), acne, rosacea, and pigmentation disorders, cosmeceutical products, such as moisturizers, sunscreens, anti-wrinkle creams, and baldness treatments, nutraceuticals, other over-the-counter products, household items such as adhesives, glues, paints and cleaners, industrial items such as lubricants, dyes and compounds, and food items such as icing, cheese, yogurt, milk, tomato paste, and baby food, and condiments, such as mustard, ketchup, mayonnaise, jelly and syrup. As may be recognized by those of ordinary skill in the pertinent art based on the teachings herein, this list is intended to be exemplary and in no way limiting.

The container includes any type of container that can hold the substance. For instance, the body 20 of the container may be made of any material that is currently known or that later becomes known for performing the functions of the container as described herein. In an exemplary embodiment, the body 20 may be all plastic, aluminum, a combination thereof, and/or a plurality of other suitable materials well known to those skilled in the art now and later discovered. In another exemplary embodiment, the body 20 is made from a coextruded sheet containing various combinations of LDPE, LLDPE, HDPE, tie resins and foil. The body 20 can be customized for the application, for example, by color, shape, decoration, coatings and the like. Additionally, the container 16 can be sized to hold any desired volume of product or otherwise as may be desired. The body 20 also preferably provides a barrier to oxygen, moisture, flavor loss and the like as may be desired or otherwise required by a particular application.

In these exemplary embodiments, the body 20 may be squeezed in a conventional manner, such as by squeezing the body on opposites sides relative to each other and, in turn, transmitting a substantially radially-directed force into the body. By squeezing the body, the pressure of the product or other substance contained within the body is increased until the pressure is great enough to push the product out of the valve assembly 14.

In another exemplary embodiment, the container 16 may include a more rigid body and a flexible bladder located in the container that holds the substance, such as that disclosed in U.S. Pat. Nos. 6,892,906 and 6,761,286, each of which is hereby expressly incorporated by reference as part of the present disclosure.

Figure 3:
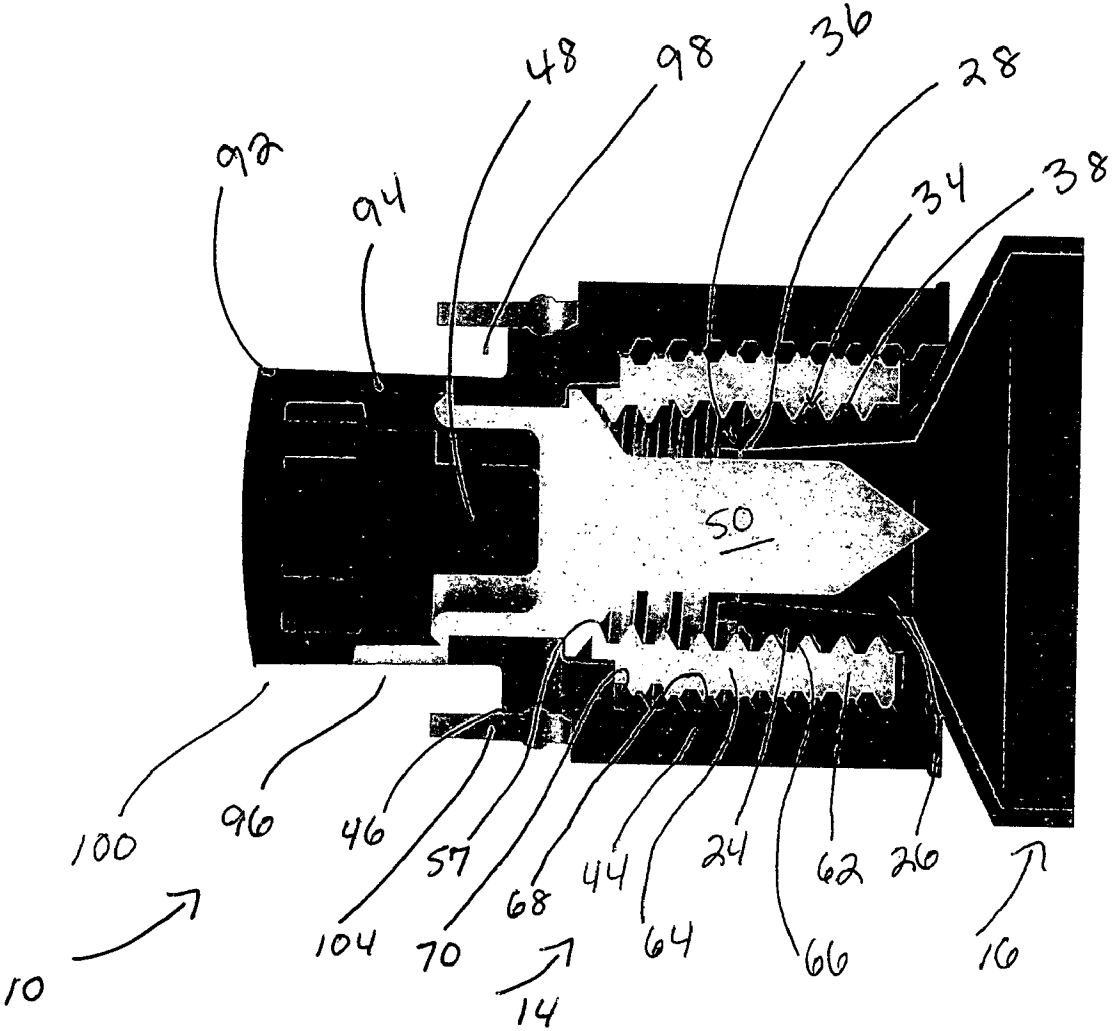
FIG. 3 is a cross-sectional view of the device of FIG. 2 illustrating the valve assembly with a frangible member removed and the valve assembly connected in fluid communication with the container for dispensing substances therefrom.
Figure 4:
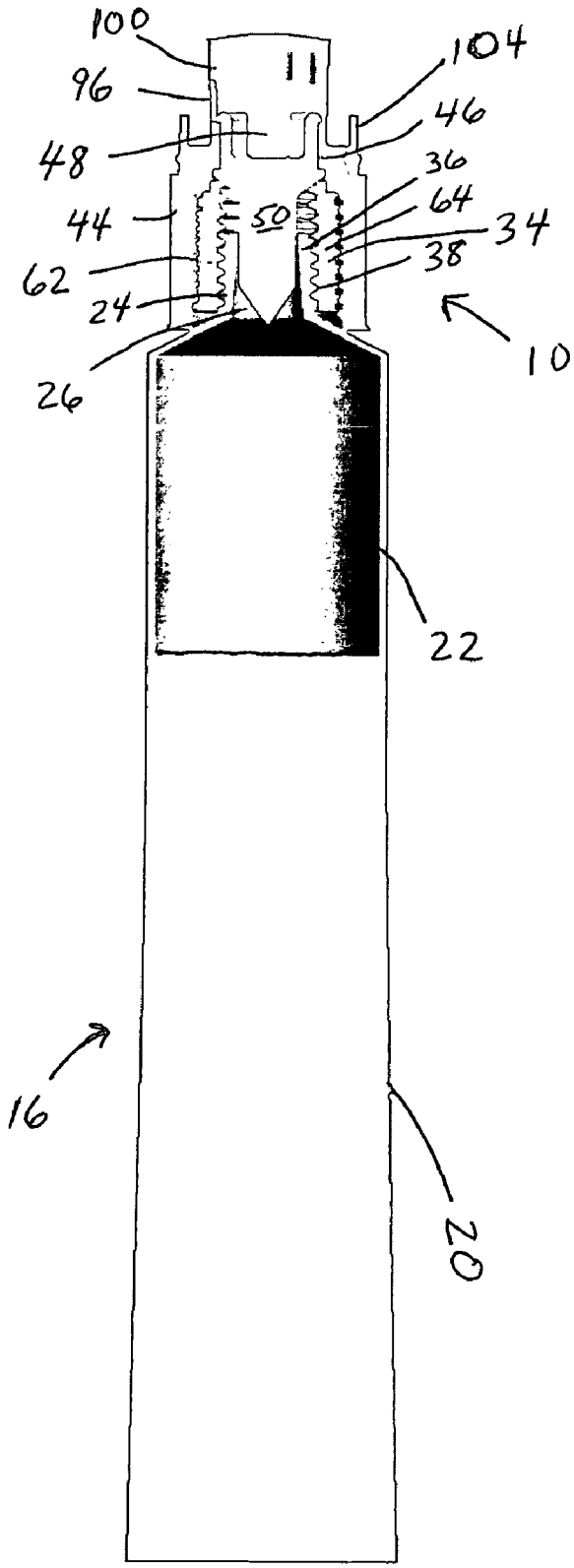
FIG. 4 is a partial cross-sectional view of the device of FIG. 3 illustrating a complete view of the container with the cap removed from the valve assembly.

The container 16 includes a head 24 that is located at one end of the body 20. A first axially-extending passageway 26 is coupled in fluid communication with the storage chamber 22 of the body 20 and defines an unobstructed axially-extending flow path therebetween. A pierceable wall 28 is located on the opposite side of the axially-extending passageway 26 relative to the storage chamber 22. As shown in FIG. 1, the pierceable wall 28 is normally closed to hermetically seal the substance in the storage chamber 22. However, as shown in FIG. 3 and described further below, the pierceable wall 28 is pierceable to break the seal and allow substance to flow from the storage chamber 22 therethrough.

The container 16 further includes a first connecting portion 34 for connecting the valve assembly 14 thereto. In the illustrated embodiment, the first connecting portion 34 includes a head 24 configured as an annular raised portion 36 having threads 38 for threaded connection with the valve assembly 14. However, as may be recognized by those of ordinary skill in the pertinent art based on the teachings herein, the connecting portion may define any of numerous other connecting mechanisms that are currently known to that later become known.

Figure 6:
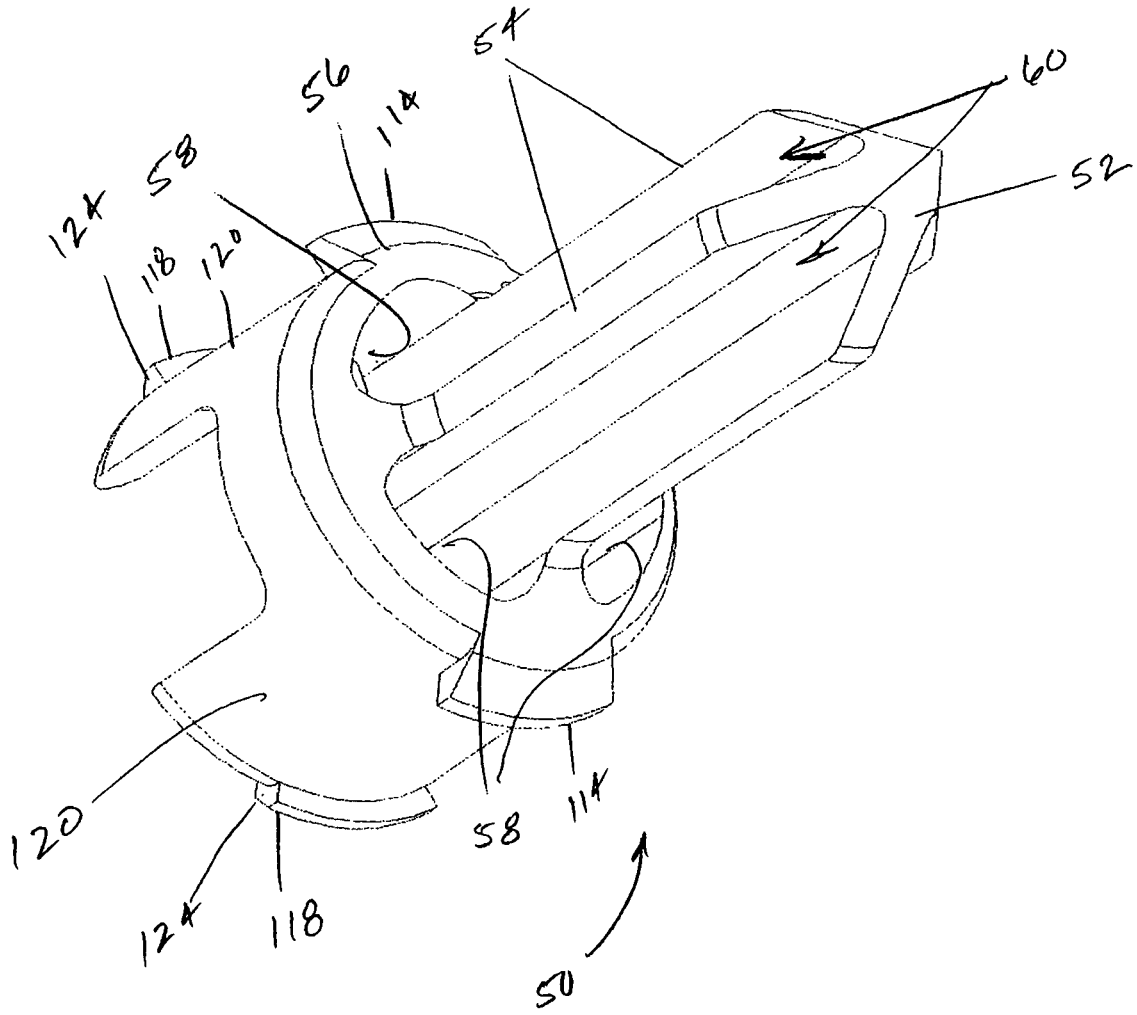
FIG. 6 is a perspective view of a piercing portion of the valve assembly illustrated in FIGS. 1, 3 and 4 for providing fluid communication between the valve assembly and the container.

The one-way valve assembly 14 comprises a valve body 44 including a body base 46 defining a second axially-extending passageway 48 connectable in fluid communication with the first axially-extending passageway 26 of the container 16. A piercing portion 50 of the valve assembly is engageable with the pierceable wall 28 of the container 16. In the illustrated embodiment, at least one of the piercing portion 50 of the valve assembly 16 and the pierceable wall 28 of the container 16 is movable relative to the other between a first position, shown typically in FIG. 1, wherein the piercing portion 50 is not piercing the pierceable wall 28, and a second position, shown typically in FIG. 3, wherein the pierceable portion 50 pierces and extends through the pierceable wall, and the first axially-extending passageway 26 of the container 16 is connected in fluid communication with the second axially-extending passageway 48 of the valve body 44 for allowing the flow of substance from the storage chamber 22 therethrough. Also in the illustrated embodiment, the piercing portion 50 defines an axially-extending piercing surface 52 that projects into the first axially-extending passageway 26 upon movement from the first position, shown typically in FIG. 1, to the second position, shown typically in FIG. 3. As shown in FIGS. 1 and 3, the piercing surface 52 tapers radially inwardly when moving in the axial direction toward the storage chamber 22. As best seen in FIG. 6, the piercing portion 50 includes four members 54 defining the piercing surface 52 at one end and joined to a base 56 at an opposite end. Each of the four members 54 includes a longitudinal edge joined to a respective longitudinal edge of each of the other three members 54. The base 56 includes fluid flow apertures 58 providing fluid communication between the first and second passageways 26 and 48, respectively. The four intersecting members 54 define four channels 60 extending along an axial length of the four intersecting members 54. Each channel 60 is in fluid communication with a corresponding fluid flow aperture 58 in the base 56 to allow axial flow of product through the second passageway and the one flow aperture in the base. It should be recognized by one skilled in the pertinent art that although the piercing portion 50 has been described as including four intersecting members 54 defining four equally sized channels 60 therebetween, any number of members 54 are contemplated, including one or more members creating two or more channels 60 that may or may not be equally sized. As may be recognized by those of ordinary skill in the pertinent art based on the teachings herein, the members 54 defining the piercing portion 50 may take any of numerous different forms or configurations that are currently known or that later become known for performing the functions of the piercing members as described herein.

Referring again to FIGS. 1-4, the valve assembly 14 further includes a second connecting portion 62 that is connectable to the first connecting portion 34 of the container 16 for fixedly securing the valve assembly 14 to the container 16 when the valve assembly and container are located in either the first position (FIG. 1) or the second position (FIG. 3). In the illustrated embodiment, the second connecting portion 62 includes a bushing 64. The bushing 64 includes internal threads 66 for threadedly engaging threads 38 on head 24. The bushing 64 also includes external threads 68 for threadedly engaging threads 70 on the valve body 44. However, in an alternative embodiment as may be recognized by those of ordinary skill in the pertinent art based on the teachings herein, the second connecting portion 62 may be integral with the valve body 44 such that the connection portion 62 includes threads 70 configured to threadedly engage threads 38 of the first connecting portion 34 without using a bushing 64.

Figure 18:
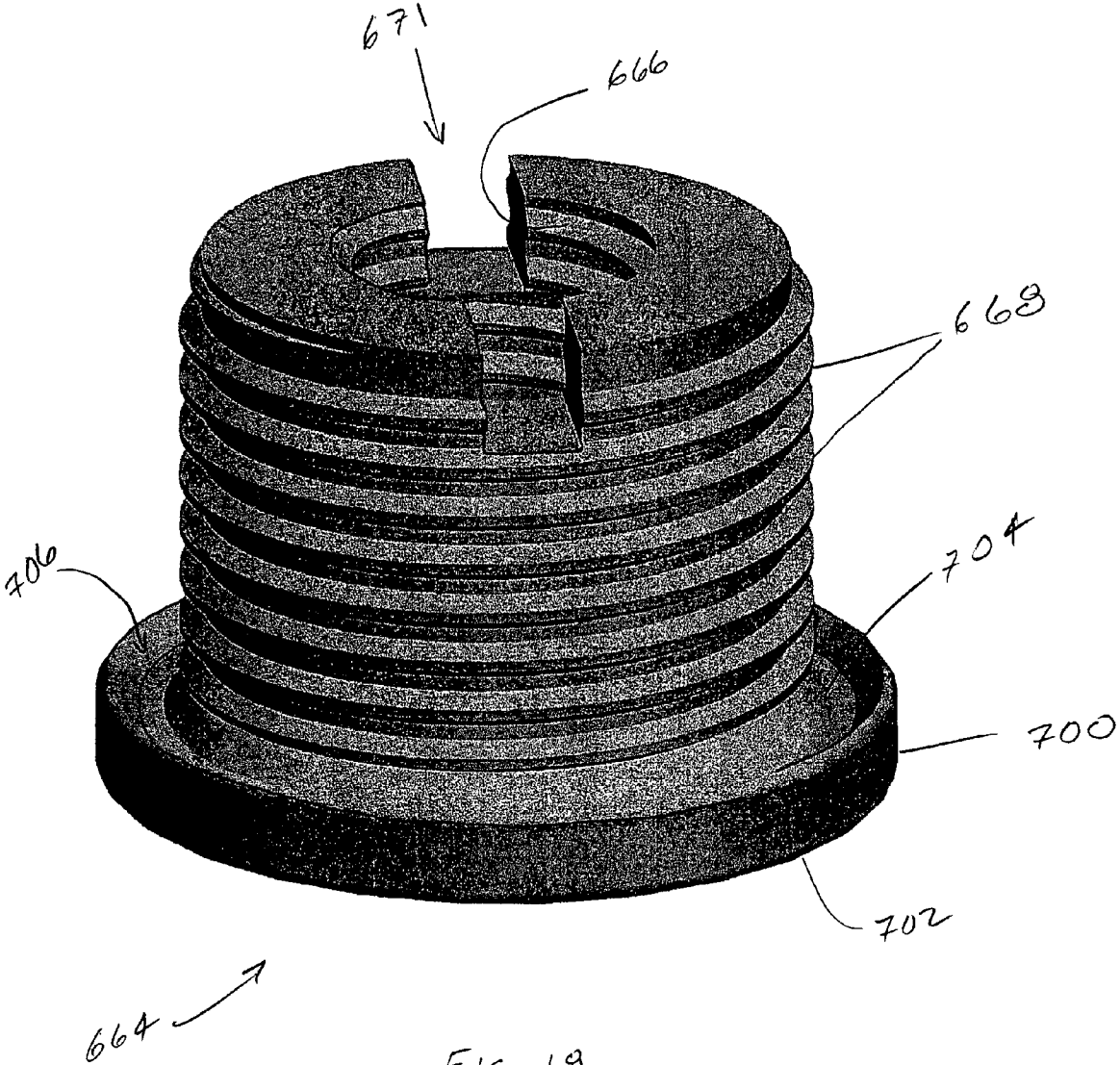
FIG. 18 is a perspective view of the bushing of FIGS. 16 and 17 used to connect the valve assembly to the container.

In an exemplary embodiment, the bushing 64 is used to extend the axial length of the first connecting portion 34 by presenting additional threads via external threads 68 to engage internal threads 70 of the valve body 44. In this manner, there is a suitable length of threads for translation of the valve assembly between first and second positions (FIGS. 1 and 3, respectively) discussed more fully below. As best seen with reference to FIG. 7, bushing 64 is configured with a slot 71 for engagement with a tool, such as a flat head screwdriver (not shown), during assembly with the first connecting portion 34 (see also slot 671 for bushing 664 in FIG. 18). However, other suitable tool head configurations are contemplated and this feature is not limited to a flat head screwdriver slot 71.

Figure 5:
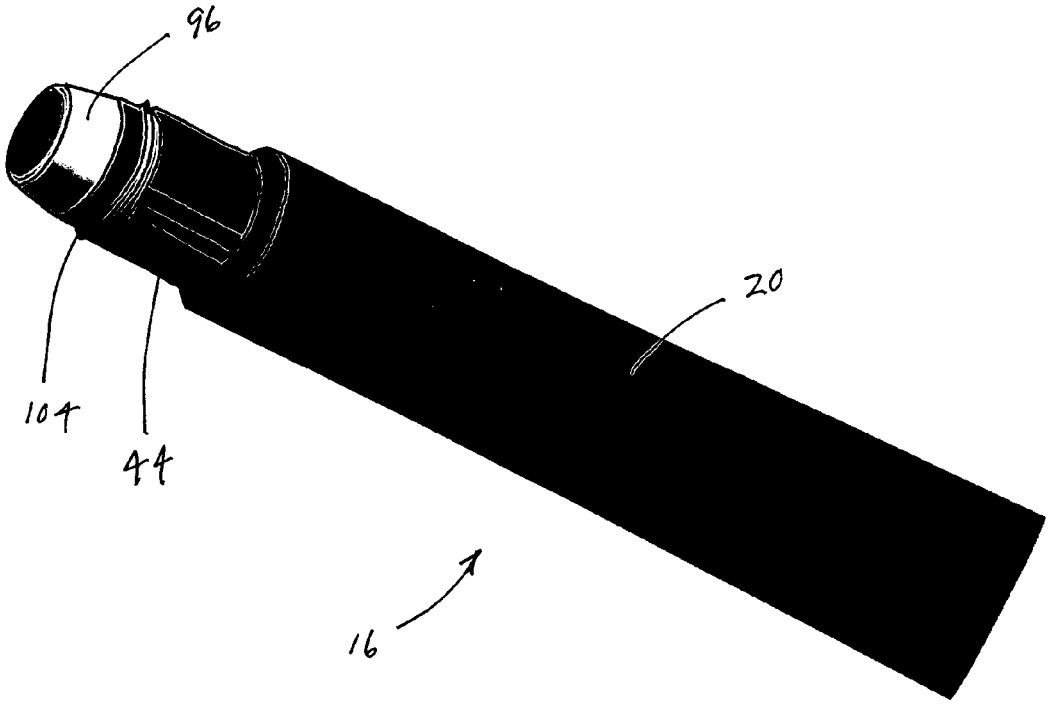
FIG. 5 is a perspective view of the device of FIG. 3 illustrating the cap removed therefrom.
Figure 8:
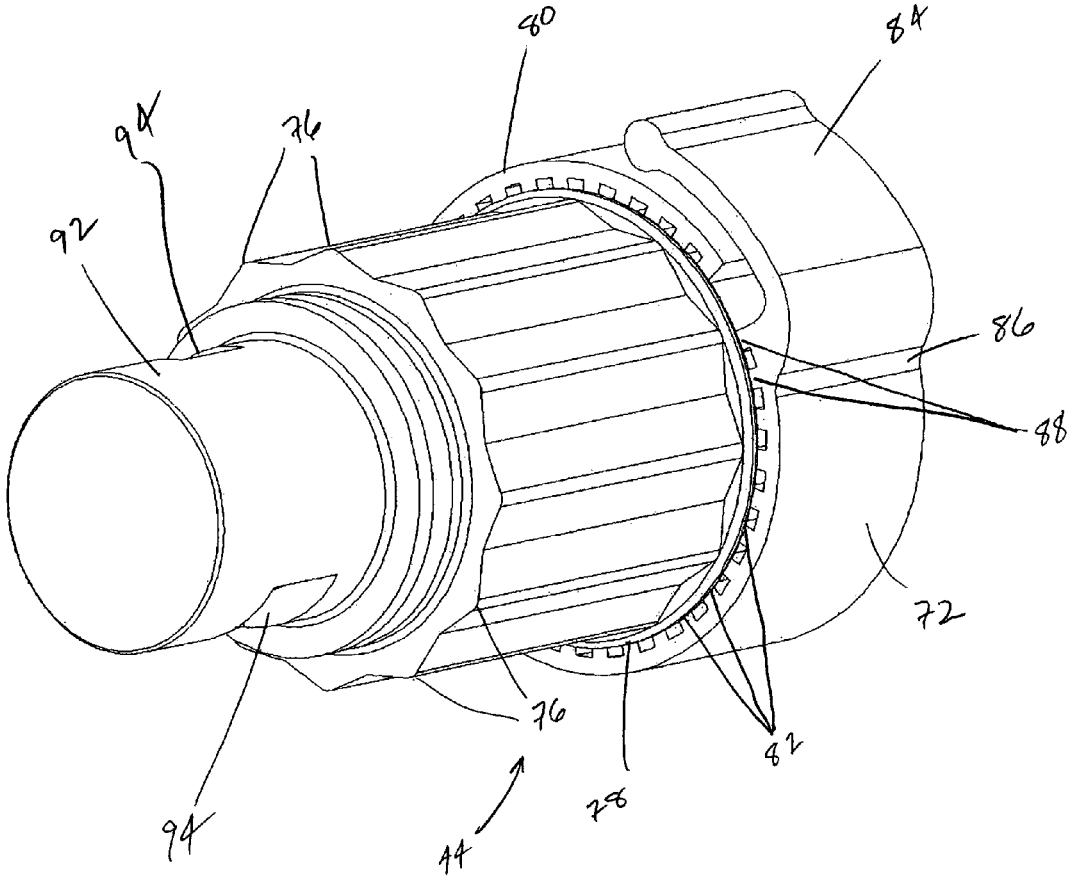
FIG. 8 is a perspective view of a valve body of the valve assembly of FIG. 7.
Figure 9:
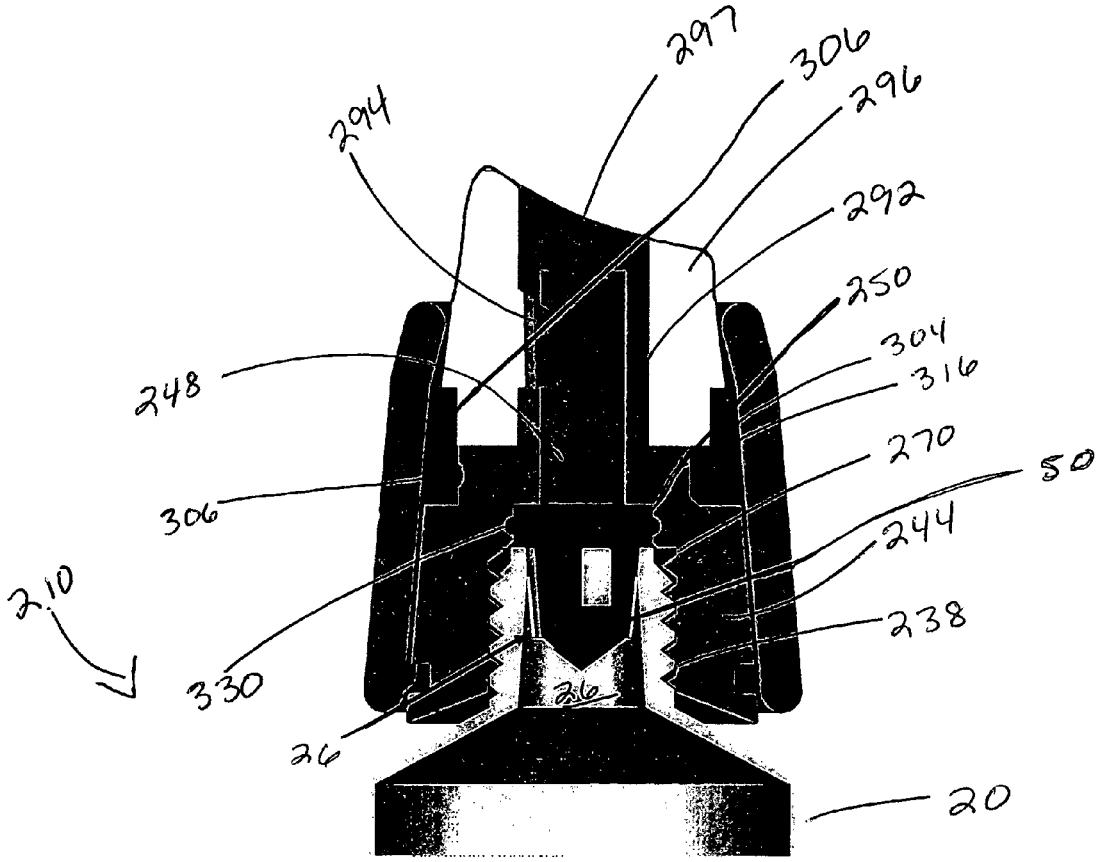
FIG. 9 is a cross-sectional view of another one-way valve assembly and partial container particularly suited for applying products, such as cosmetics or cosmeceutical products, to a user's lips or other facial surfaces.
Figure 10:
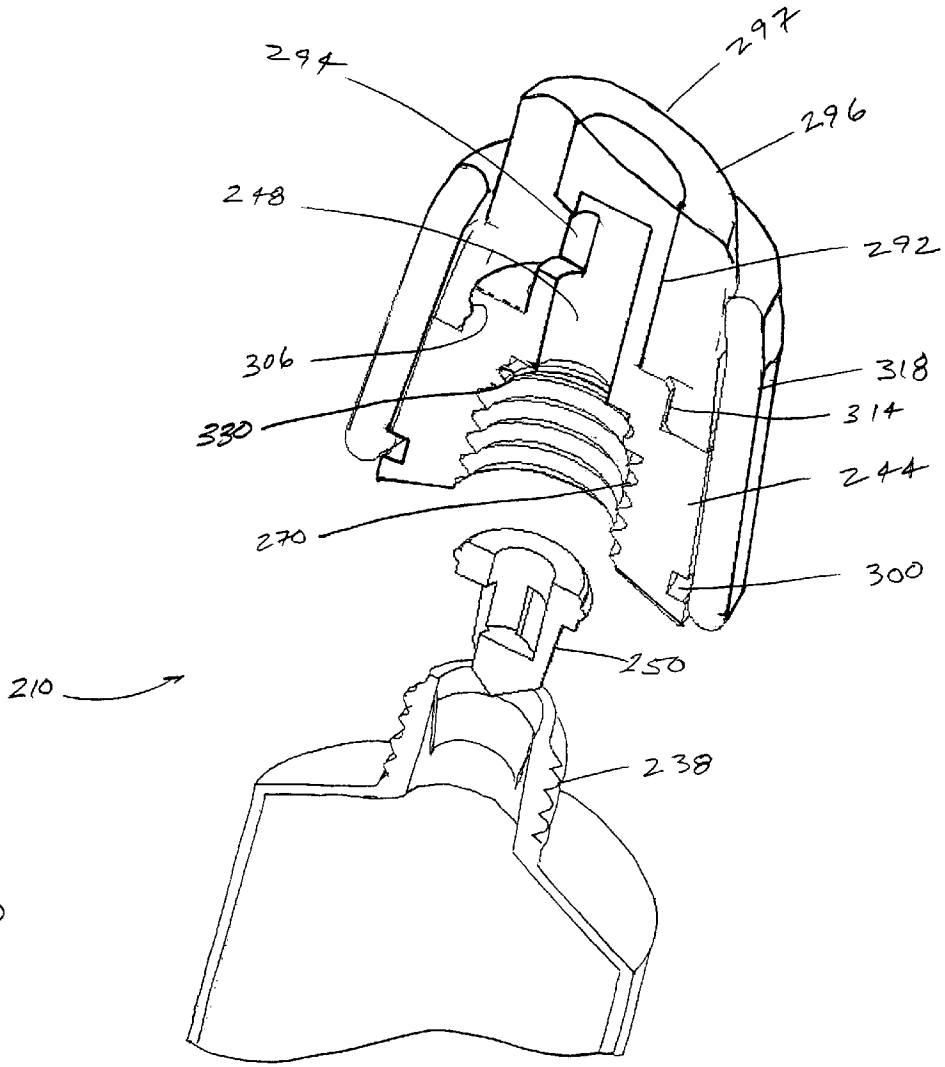
FIG. 10 is a cross-sectional perspective view of the device of FIG. 9 illustrating a piercing portion separated from the one-way valve assembly and container.

In order to connect the valve assembly 14 to the tube 16, and as indicated by the arrow in FIG. 1, the bushing 64 is threadedly attached to the head 24 and tightened down thereon using a flat head screwdriver received within slot 71. Then, the internal threads 70 of the valve body 44 are engaged with the external threads 68 of the bushing 64. The valve body 44 is manually screwed down until a removable member 72 disposed intermediate the valve body 44 and container 20 abuts both the valve body 44 and container 20. As illustrated, the removable member 72 is a frangible member 74 having one edge depending from the valve body 44, in which case the valve body 44 is manually screwed down until an opposite edge of the frangible member 74 contacts the container 20. It will be recognized by those skilled in the pertinent art that the removable member 72 may take any numerous different configurations that are currently known or that later become known for example, the removable member may resemble the frangible member 74 but for a frangible connection with the valve body 44. The valve body 44 tightened down in this position with the frangible member in tact with the valve body 44 corresponds to the first position. As best seen in FIGS. 5 and 8, an exposed peripheral portion of the valve body 44 includes axially-extending ridges or ribs 76 to facilitate gripping the valve body 44 for manually threading the valve body 44 on and off of the bushing 64. The axially-extending ridges 76 extend to a base portion 78 defining a lower portion of the valve body 44.

As an alternative method of attaching the valve assembly 14 to the tube 16, the bushing 64 may be preassembled to the valve body 44 during manufacture of the valve. The bushing 64 is threaded into the valve body 44 and tightened to a specified torque such that the frangible member 74 is not damaged during the assembly process. The resulting assembly is then threaded onto the tube 16, to a specified application torque, at the point of manufacture of the tube.

Referring now to FIG. 8, the frangible member 74 includes a removable tear strip 80 on the lower portion of the valve body 44 having a line of weakness connection 82 adjacent to the base portion 78. The removable tear strip 80 extends along a substantial portion of the circumference of the lower portion of the valve body 44. A pull tab 84 extends from one end of the strip 80 allowing the tear strip to be pulled to tear the tear strip at a line of weakness 82. The line of weakness 82 defines a joint between the base portion 78 and strip 80. In particular, the line of weakness 82 between the base portion 78 and strip 80 defines a frangible portion at which the removable tear strip is severed from the base portion. With removal of the tear strip, the now lower edge of the remaining valve body 44, defined by the base portion 78, can be translated toward the container 16, as discussed more fully below. It will be recognized by those skilled in the pertinent art that direction of removable of the frangible member 74 by the tear strip 80 is the same as the direction of rotation required to tighten the threaded bushing 64 onto the tube 16. If the direction of removal of the frangible member 74 by the tear strip 80 is opposite to that of the direction of rotation required for tightening the bushing 64, there is a risk of loosening the entire valve assembly from the tube during removal of the frangible member 74.

Figure 2:
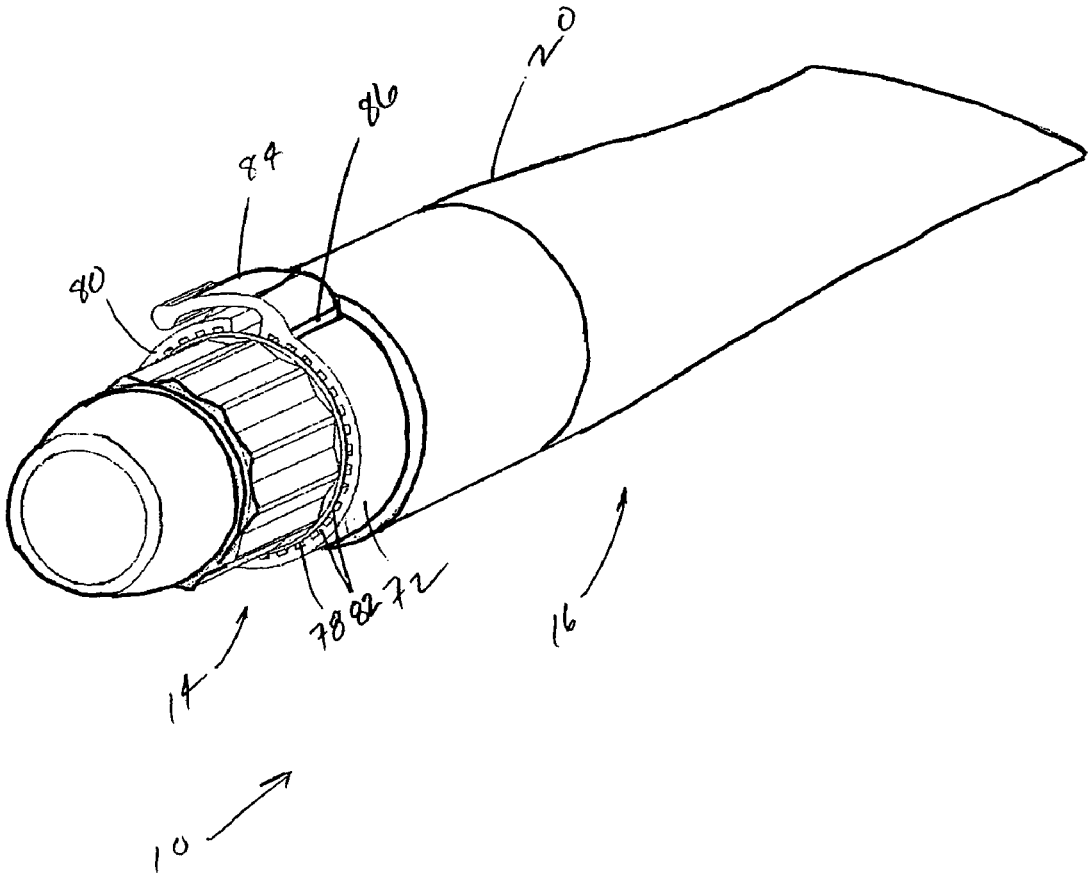
FIG. 2 is a perspective view of the device of FIG. 1 illustrating the components of the device assembled together, and the cap removed, prior to connecting the valve assembly in fluid communication with the container.

In an exemplary embodiment as depicted in FIGS. 2 and 8, the pull tab 84 for the removable tear strip 80 is molded integrally with the valve body 44. The pull tab 84 is spaced radially outwardly relative to the tear strip 80 to facilitate gripping the pull tab and allowing the tear strip to cover a greater portion of the circumference of the valve body 44. The pull tab 84 includes a hinged portion 86 connecting the pull tab 84 to the tear strip 80. Pivoting the pull tab 84 about the hinged portion 86 causes the frangible portion underlying the pull tab 84 indicated at 88 to break and to separate from the base portion 78, and thereby freely extend the pull tab 84 radially outwardly of the container ring to facilitate grasping for tearing away a remainder of the tear strip 80 from the base portion 78. Accordingly, the pull tab 84 is adapted such that a radial or tangential pulling force on the pull tab breaks the frangible portion and opens the tear strip, and thereby facilitates tearing at the line of weakness to remove the tear strip from the valve body.

The frangible portion or line of weakness 82 includes intermittent connection points between the strip 80 and an edge defining the base portion 78. In alternative embodiments, the frangible portion or line of weakness may include a relatively thin cross-sectional joint between the connection strip 80 and base portion 78, at which the tear off of strip 80 is facilitated by severing the strip 80 from the base portion 78 of the valve body 44 at the relatively thin cross section of material therebetween.

In order to connect the valve assembly 14 to the tube 16 for fluid communication therebetween, the frangible member 74 is removed from the valve assembly 14 to allow translation of the piercing portion 50 through the pierceable portion or end wall 28 of the container 16. Then, as indicated by the arrow in FIG. 1, the valve assembly 14 is moved toward the container (or vice versa) from the first position, shown typically in FIG. 1, to the second position shown typically in FIG. 3, wherein the valve body 44 is manually and axially rotated due to threaded engagement therebetween. When moving axially from the first position into the second position, the piercing surface 52 of the piercing portion 50 pierces or breaks through the pierceable end wall 28 of the container and, in turn, connects the first axially-extending passageway 26 of the container in fluid communication with the second axially-extending passageway 48 of the valve assembly. Also in the second position, as best seen with reference to FIG. 3, a radially inward taper defines a surface of the base 56 of the piercing portion 50 that sealingly engages an annular surface 57 defined by an opening in the bushing 64 to form a fluid-tight or hermetic seal there between.

As best seen in FIG. 8, the valve body 46 further includes an axially-extending valve seat 92 and a plurality of flow apertures 94 radially extending through the valve body adjacent to the valve seat and coupled in fluid communication with the second axially-extending passageway 48 for receiving the substance from the storage chamber 22 therethrough. In an exemplary embodiment, as depicted in FIG. 8, the flow apertures 94 are diametrically opposed. However, it will be recognized by those skilled in the pertinent art that additional apertures could be added, although such configurations may require a more complex mold. As seen with reference to FIGS. 1-5, the valve assembly 14 further includes a valve cover 96 that is formed of an elastic material and includes a cover base 98 mounted on the body base 46 and fixedly secured against axial movement relative thereto, and a valve portion 100 overlying the valve seat 92. The valve portion 100 defines a predetermined radial thickness and a diameter less than a diameter of the valve seat 92 to thereby form an interference fit therebetween, and the valve portion and the valve seat define a normally closed, annular, axially-extending valve opening therebetween. The valve portion 100 is movable radially between a normally closed position with the valve portion engaging the valve seat 92, and an open position with at least a segment of the valve portion spaced radially away from the valve seat to allow the passage of substance therebetween. The valve seat and valve cover may be the same as or similar to one or more embodiments disclosed in the following co-pending patent applications, and further detailed features of the valve seat and cover are described further therein: U.S. patent application Ser. No. 11/008,887, filed Dec. 9, 2004, entitled "Container And Valve Assembly For Storing And Dispensing Substances, And Related Method", and U.S. patent application Ser. No. 10/976,349, filed Oct. 28, 2004, entitled "Container And Valve Assembly For Storing And Dispensing Substances, And Related Method", and U.S. Pat. No. 6,892,906, filed Aug. 13, 2003, entitled "Container And Valve Assembly For Storing And Dispensing Substances, And Related Method", and U.S. patent application Ser. No. 29/199,062, filed Feb. 9, 2004, entitled "Tube and Valve Assembly", and U.S. Pat. No. D503, 611, filed Jan. 27, 2003, entitled "Container and Valve Assembly", and U.S. patent application Ser. No. 29/221,797, filed Jan. 20, 2005, entitled "Container and Valve Assembly", and U.S. patent application Ser. No. 29/226,010, filed Mar. 23, 2005, entitled "Tube", and U.S. patent application Ser. No. 29/188,310, filed Aug. 15, 2003, entitled "Tube and Valve Assembly", U.S. patent application Ser. No. 29/191,510, filed Oct. 7, 2003, entitled "Container and Valve Assembly," all of which are incorporated herein by reference as part of the present disclosure.

Figure 7:
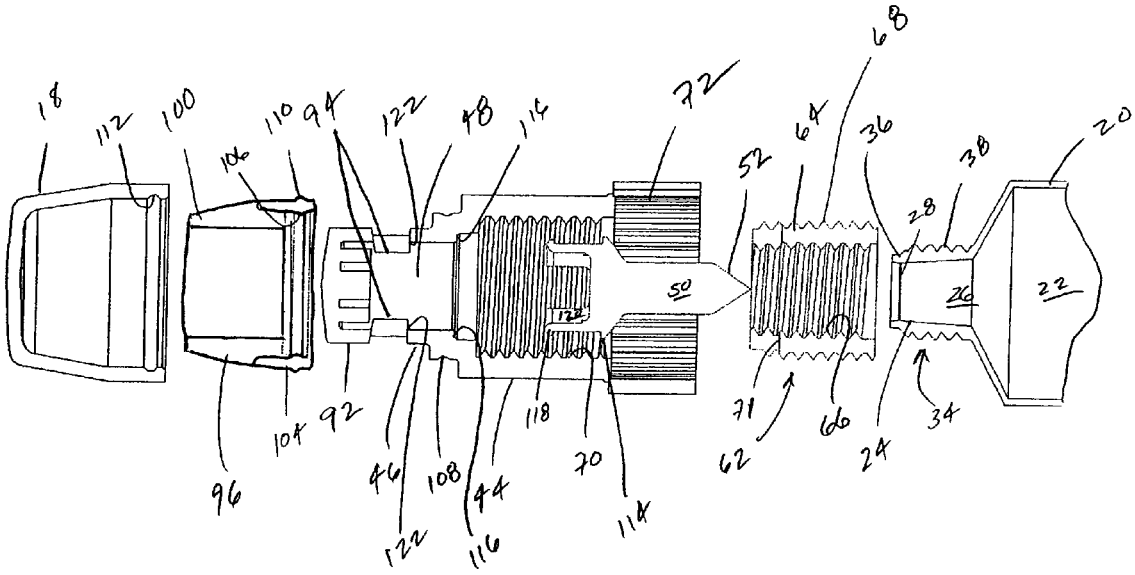
FIG. 7 is an exploded cross-sectional view of the device of FIG. 1 illustrating the cap and separable parts of the valve assembly before assembly thereof.

The valve assembly further includes a securing snap ring 104 that extends about the periphery of the base 98 of the valve cover to fixedly secure the valve cover to the valve body and prevent removal of the valve cover therefrom. In an exemplary embodiment as shown in FIGS. 1-4 and 7, the valve cover 96 is overmolded to the snap ring 104. The snap ring 104 includes a radially inwardly extending annular raised portion 106. The base 78 of the valve body 44 includes a complementary configured annular recessed portion 108 for snap-fit engagement with the annular raised portion 106. As best seen in FIG. 7, the snap ring 104 also includes a radially outwardly extending annular raised portion 110 opposite the annular raised portion 106. The cap 18 includes a complementary configured annular recessed portion 112 for snap-fit engagement with the annular raised portion 110. In this manner, the snap ring 104 snap-fits to base 78 of the valve body, and the cap 18 snap-fits to the snap ring 104.

Referring to FIGS. 1, 6 and 7, in the illustrated embodiment the piercing portion 50 is configured for snap-fit assembly with the valve body 44. The base 56 of the piercing portion 50 includes a first pair of opposing snap-fit tabs 114 extending therefrom for engagement with a first shoulder 116 defined by the valve body 44. The tabs 114 abutting the first shoulder 116 prevent translation of the piercing portion 50 in a direction opposite that indicated by the arrow in FIG. 1. A second pair of snap-fit tabs 118 are axially spaced and substantially aligned relative to a corresponding snap-fit tab 114. Each tab 118 extends from a corresponding wall portion 120 intermediate the respective tabs 114, 118 and is configured for snap-fit engagement with a second shoulder 122 defined by the valve body 44. Each tab 118 on a separate wall portion 120 includes a radially inwardly taper 124 to facilitate snap-fit engagement with the base 46 of the valve body 44 and to allow translation of the piercing portion 50 in a direction opposite the arrow in FIG. 1 during assembly of the piercing portion 50 with the valve body 44. By having each of the tabs 118 on a separate wall portion 120 extending from the base 56, the tabs 118 may be resiliently displaced radially inwardly to allow translation thereof through a narrow passageway defined by the valve body intermediate the first and second shoulders 116 and 122.

Referring now to FIG. 7, assembly and use of the device 10 is described below in accordance with an exemplary embodiment of the present invention. First, the bushing 64 is threaded onto the tube head 26. The piercing portion 50 is then axially translated through the valve body 44 for snap-fit engagement of tabs 114, 118 with respective shoulders 116, 122. The valve cover 96 is overmolded to the snap ring 104 which, in turn, is snap-fit to the body base 46 of the valve body 44. Next, the valve body 44 is threaded onto the bushing 68 until the removable member 72 engages the tube 16. The removable member 72 serves as a hard locating point when assembling the valve body 44 onto the tube 16.

In use, the user removes the removable member 72 to allow further tightening of the valve body 44 down toward the tube 16 in order for the piercing portion 50 to pierce the wall 28 sealing the tube 16. Once the wall 28 is pierced with the piercing portion 50 disposed in the valve body 44, the first and second passageways are in fluid communication and the substance contained in the tube can be dispensed therefrom. Once fully assembled, the attachable valve assembly 14 provides a one-way valve for the prefilled tube 16.

In FIGS. 9-14, another container and one-way valve assembly embodying the present invention is indicated generally by the reference numeral 210. The container and one-way valve assembly 210 is similar in certain respects to the device 10 described above, and therefore like reference numerals preceded by the numeral "2" are used to indicate like elements. A primary difference of the container and valve assembly 210 in comparison to the device 10 described above is that the valve cover 296 and valve seat 292 cooperate to define a curvilinear-shaped applicator surface 297 that is shaped to conformably contact a facial contour, such as a user's lips. As shown typically in FIGS. 9 and 10, the applicator surface 297 defines a substantially concave contour in cross-section, and is substantially defined by a radius "R"(see FIG. 11). The illustrated applicator surface shape is particularly suited for applying, for example, liquid lipstick to a user's lips. However, as may be recognized by those of ordinary skill in the pertinent art based on the teachings herein, the device 210 may be used to apply any of numerous different products to any of numerous different types of surfaces, including without limitation, lip balms, medicines, or other products to a user's lips, or a concealer or other cosmetic or cosmeceutical product to other facial surfaces.

Figure 11:
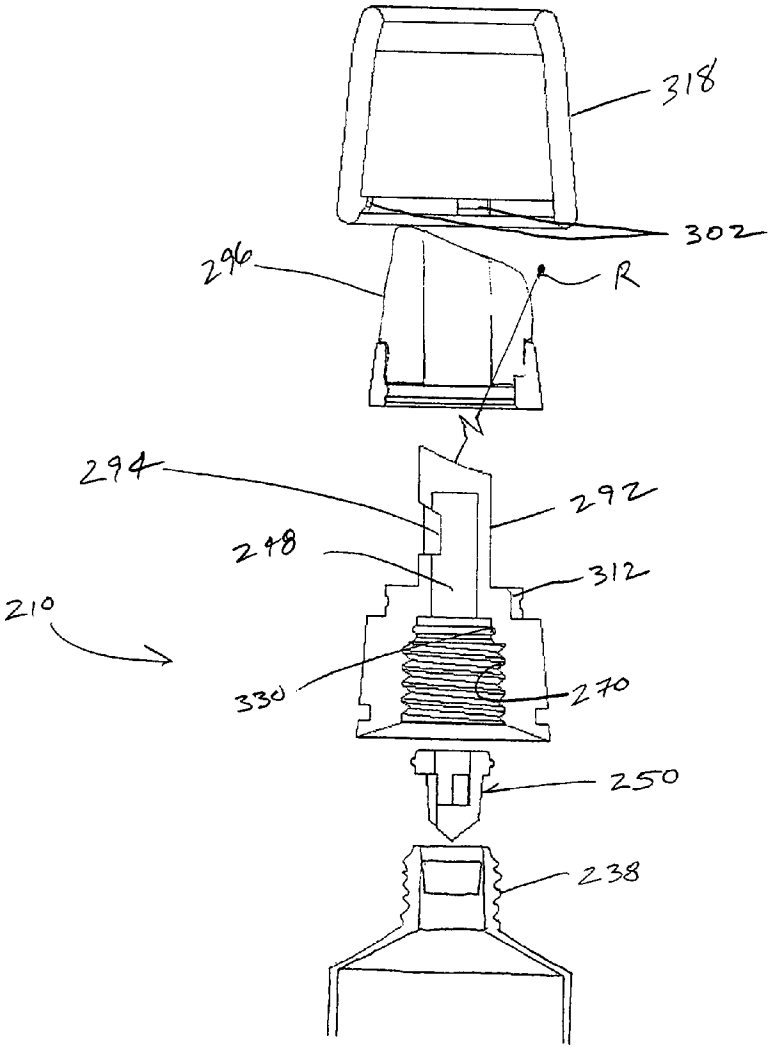
FIG. 11 is an exploded cross-sectional view of the device of FIG. 9.

Another difference of the device 210 in comparison to the device 10 described above, is that the one-way valve assembly 214 is screwed directly onto the head 224 of the container 316 without using a bushing. As shown in FIG. 11, the tube head 224 defines external threads 238, and the valve body 244 defines internal threads 270 that cooperate with the external threads 238 to fixedly secure the valve body to the tube head. In addition, the valve body 244 defines an annular recess portion 300 that engages the interior of a tamper reduction cap 318 to secure the cap to the valve and tube assembly. The cap 300 includes a plurality of radially inwardly extending guide tabs 302 (four tabs shown in FIG. 15) that reside in the annular recess portion 300 to prevent axial translation of the cap 300 relative to the valve body 244 yet allow the cap 300 to freely rotate about an axis defining the valve body 244. The tabs 302 include a radially outwardly taper 303 to facilitate assembly with the valve body while providing retention of the cap with the valve body after assembly thereto.

As shown in FIGS. 9-11 and 13, the valve body 244 defines a single flow aperture 294. In the illustrated embodiment, the single flow aperture 294 is aligned with the side of the valve cover 296 that extends axially outwardly further than an opposite side of the valve cover and valve body. The hoop stress is reduced on the outlet end of the flow path aligned with this single flow aperture 294 (because the outermost portion of the valve cover at this point does not extend a full 360 degrees, but rather defines a lesser angular extent as shown), and therefore this portion of the valve may release a greater volume of substance therethrough at the same valve opening pressure in comparison to the other side of the valve. However, as may be recognized by those of ordinary skill in the pertinent art based on the teachings herein, this flow aperture configuration is only exemplary, and the device 210 may define any of numerous different flow aperture configurations that are currently known or later become known. As can be seen, the valve cover 296 defines an interference fit, and tapered cross-sectional configuration as described in further detail above and in the co-pending patent applications incorporated by reference above.

As may be further recognized by those of ordinary skill in the pertinent art based on the teachings herein, the one-way valve assembly may be connected to the container in the same manner as any of the other embodiments described above.

The valve body 244 also includes a second annular recessed portion 308. The second annular recessed portion 308 defines a notch 312 configured to align with a tab 314 extending from a second raised annular portion 306 of the snap ring 304. The second raised portion 306 is a radially inwardly extending projection for snap-fit engagement with the second annular recessed portion 308 while the tab 314 aligns with the notch 312 to prevent rotation of the snap ring relative to the valve body. In this manner, the curvilinear valve cover remains properly aligned with the curvilinear top surface 297 defined by the radius R (FIG. 11). The curvilinear top surface illustrated in FIG. 11 with the radius R defines a concave applicator surface, however, a convex applicator surface is also contemplated.

Figure 12:
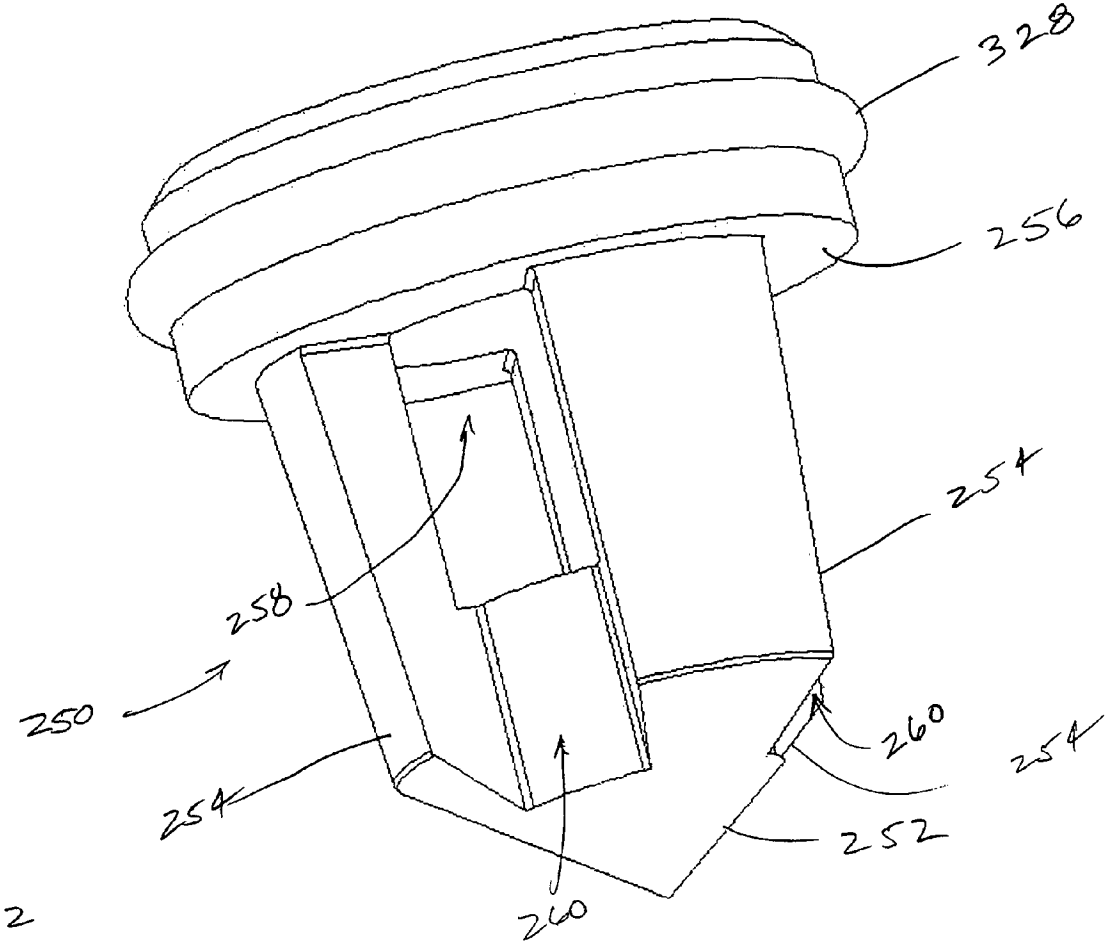
FIG. 12 is a perspective view of a piercing portion of the one-way valve assembly of the device of FIG. 9.
Figure 13:
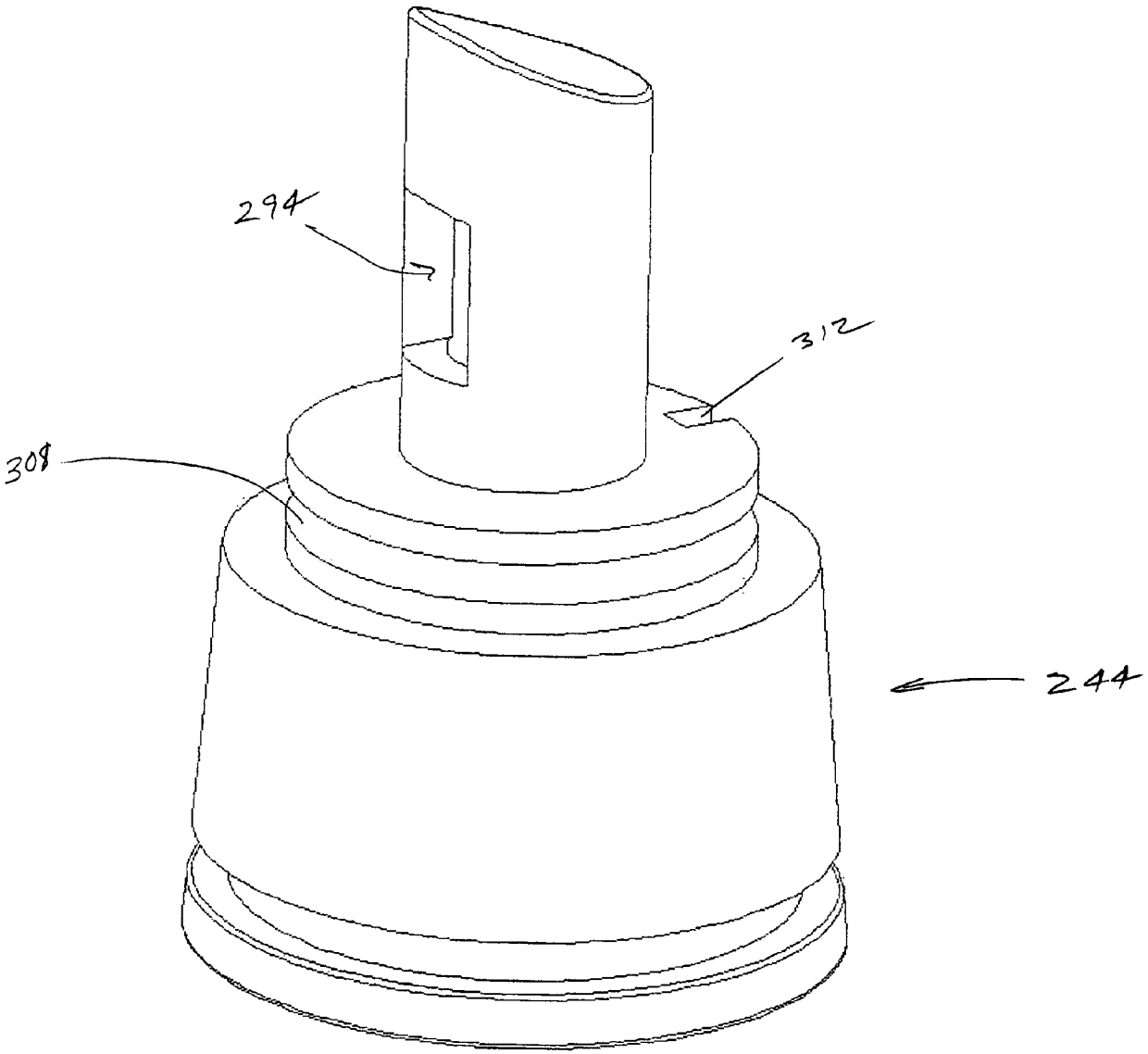
FIG. 13 is a perspective view of a valve body of the one-way valve assembly of the device of FIG. 9.
Figure 14:
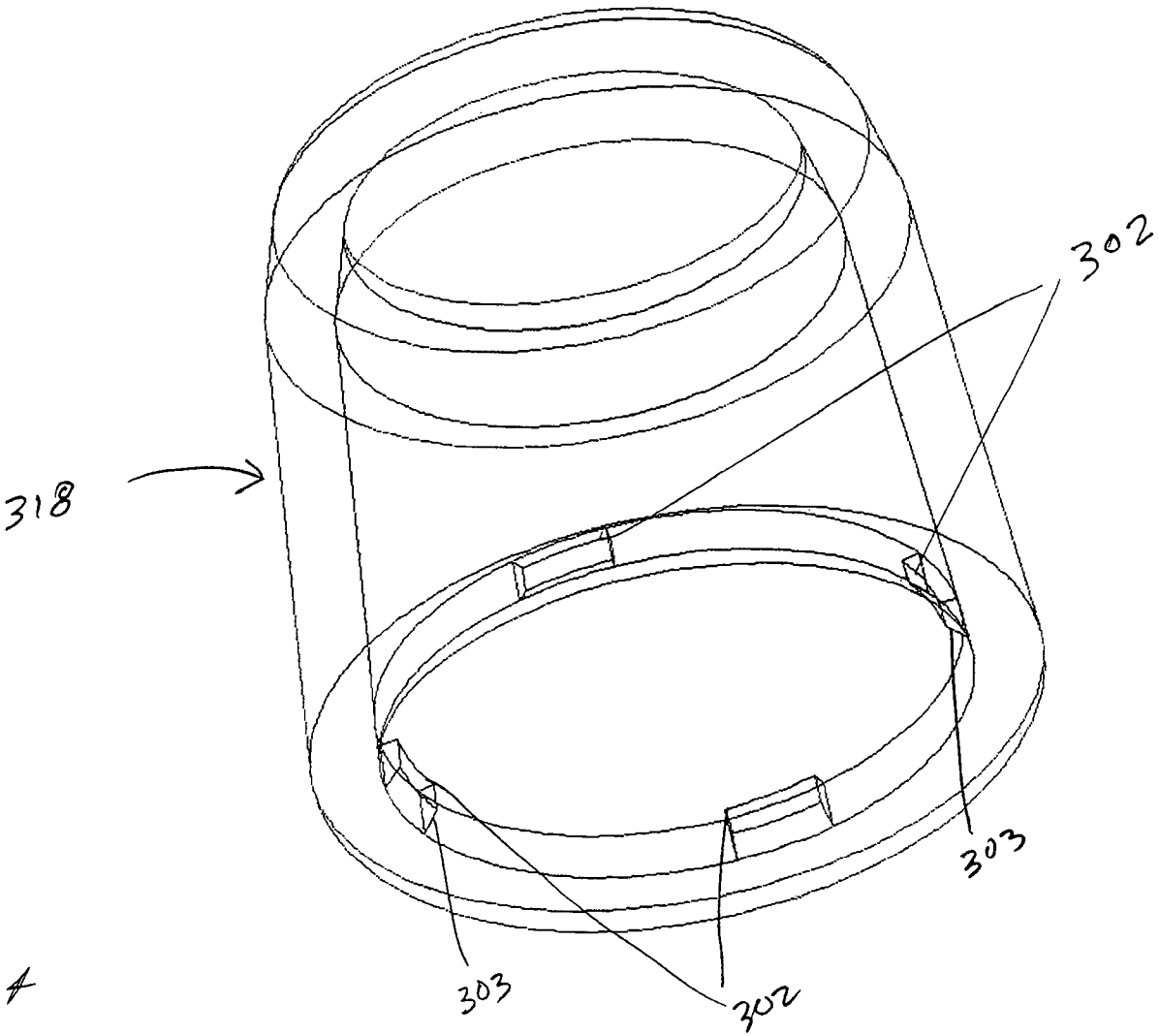
FIG. 14 is a perspective view of a cap to prevent tampering of the one-way valve assembly of the device of FIG. 9.

Referring to FIG. 12, the piercing portion 250 includes three intersecting members 254 creating three flow channels 260 (only two shown in FIG. 12). The three intersecting members 254 define a piercing surface 252 at one end and each join to the base 256 at an opposite end. The flow channels 260 are in fluid communication with the flow aperture 258 that in turn is in fluid communication with the second passageway 248. The base 256 of the piercing portion 250 includes a third raised annular portion 328 defining a circumferential edge of the base 256. The third raised annular portion 328 is received in a complimentary configured third recessed annular portion 330 in the valve body to fixedly secure the same thereto.

Figure 15:
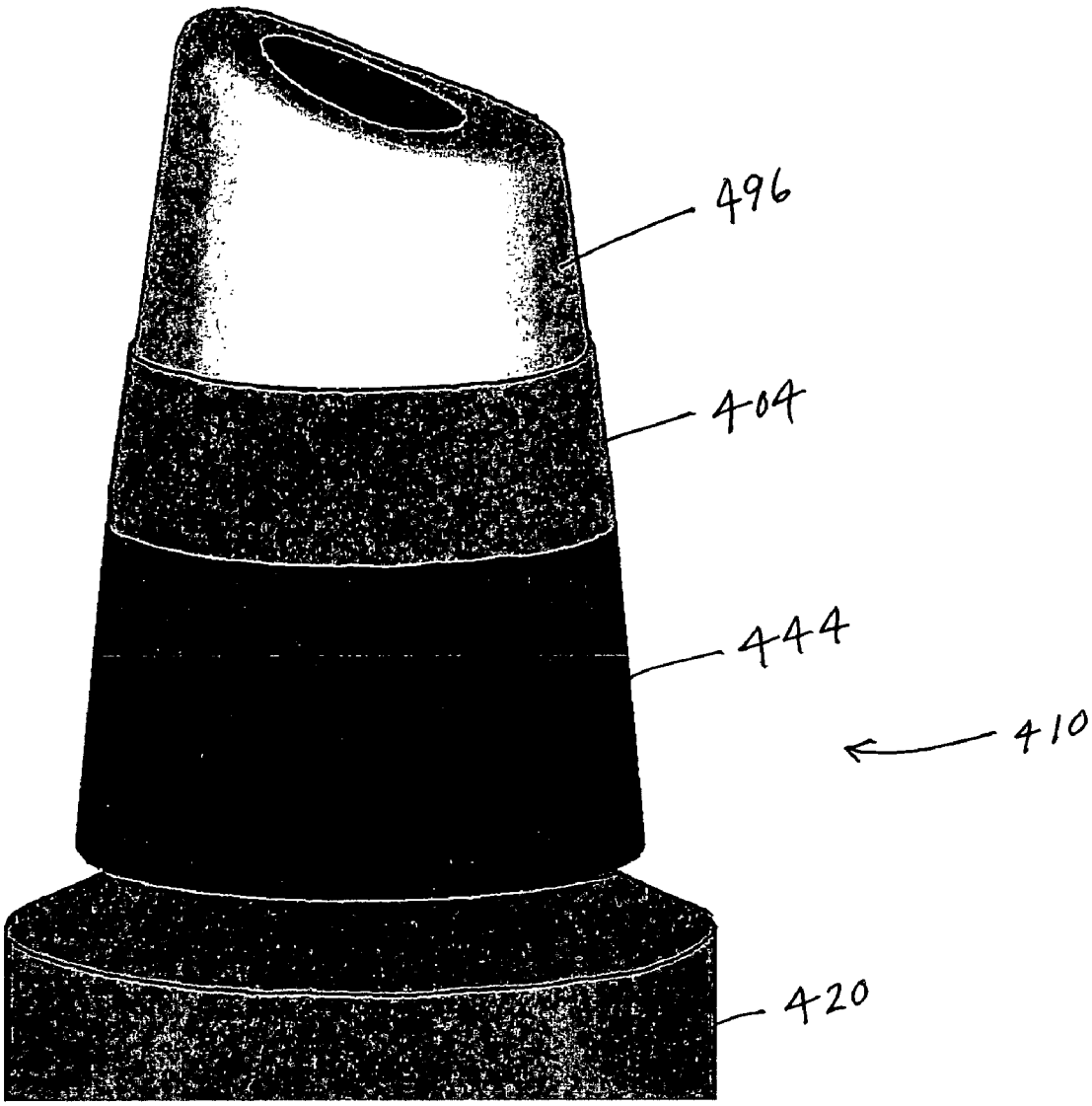
FIG. 15 is a perspective view of an alternative embodiment of the one-way valve assembly of FIG. 9 illustrating the valve body absent a cap to prevent tampering.

FIG. 15 is a container and one-way valve assembly in accordance with another embodiment of the present invention and is indicated generally by the reference numeral 410. The container and one-way valve assembly 410 is similar in certain respects to the device 210 described above with reference to FIGS. 9-14, and therefore like reference numerals preceded by the numeral "4" instead of the numeral "2" are used to indicate like elements. A primary difference of the container and valve assembly 410 in comparison to the device 210 described above is that the tamper reduction cap 318 is absent. The tamper reduction cap 318 of the embodiment of FIGS. 9-14 reduces a users' ability to remove, modify or disturb the attachable valve assembly. However, the embodiment shown in FIG. 15 illustrates the valve body 444 absent a groove or recessed annular portion to lock the cap 318 in place. FIG. 15 illustrates an embodiment of the container and one-way valve assembly when the tamper reduction cap 318 is found to be not necessary to reduce a user's ability to remove, modify or disturb the attachable valve.

It will be recognized by one skilled in the pertinent art that a tamper resistant system may be employed with the device 10 of FIGS. 1 and 2 to prevent and/or indicate whether the tube 16 covered by the valve assembly 14 has been tampered with. For example, a tamper resistant indicating tape located at a periphery of an interface between the tube 16 and the removable member 72 of the valve assembly 14 would indicate a possibility that the pierceable wall 28 or other underlying tube portion has been tampered with (e.g., pierced), without having to remove the valve assembly to visually inspect for the possibility of the same. In an alternative embodiment, and/or in addition to the tamper resistant indicating tape surrounding the interface between the tube 16 and the removable member 72 of the valve assembly 14, the internal threads 70 of the valve body 44 and external threads 68 of the bushing 64 may be configured to allow threaded rotation in one direction only, thus preventing separation of the valve body 44 from the bushing 64. For example, a pawl-type mechanism or ratchet wheel may be included that allows the valve body 44 to be torqued down onto the bushing 64, but that substantially prevents rotation of at least one of the valve body 44 and/or bushing 64 when torque is applied in an opposite direction. In addition, the bushing 64 may be fixedly secured to the tube head after the bushing 64 is torqued down to the tube head. For example, an adhesive, other chemical bonding agent, or mechanical bonding means (e.g., heat staking) may be used to ensure that the bushing 64 can not be removed once it is installed onto the tube head.

In FIGS. 16-20, another container and one-way valve assembly embodying the present invention is indicated generally by the reference numeral 610. The container and one-way valve assembly 610 is similar in certain respects to the devices 10 and 210 described above, and therefore like reference numerals preceded by the numeral "6" instead of the numeral "2" are used to indicate like elements. A primary difference of the container and valve assembly 610 in comparison to the device 10 described above is that the bushing 664 is configured with a base portion 700 at one end thereof facing the container 616 that radially extends past the external threads 668. The base portion cooperates with both the container 616 and valve body 644 providing a stop surface to each. As shown typically in FIGS. 16-18, the base portion 700 includes a first stop surface 702 defining a radially outwardly taper having a contour similar to a contour of the taper defining the union between the body 620 and head 624. The bushing 664 is threadedly engaged with the tube head threads 638 via internal threads 666 to translate the bushing 664 toward the container 616 until the first stop surface 702 abuts the tapered portion of the container. Base portion 700 includes a second stop surface 704 opposite the first stop surface 702 providing a stop for either the frangible member 674 or the base 678 of the valve body 644. The second stop surface 704 is defined with a circumferential groove 706, and as shown best in FIG. 17, the circumferential groove 706 is configured to receive a complementary shaped terminal edge 708 of the base 678 when the frangible member is removed. As can be seen, the groove 706 defines a shoulder in which to receive the terminal edge 708 that remains when the frangible member 672 is removed from the valve body 644. In this manner, the first and second stop surfaces 702, 704, respectively, allow the bushing 664 to be torqued onto the container 620 during assembly and allow the valve body 644 to be torqued against the second stop surface 704 defined by the groove 706. Therefore, the base portion 700 protects the container and provides a more reliable surface for assembly of the valve body 644.

Figure 19:
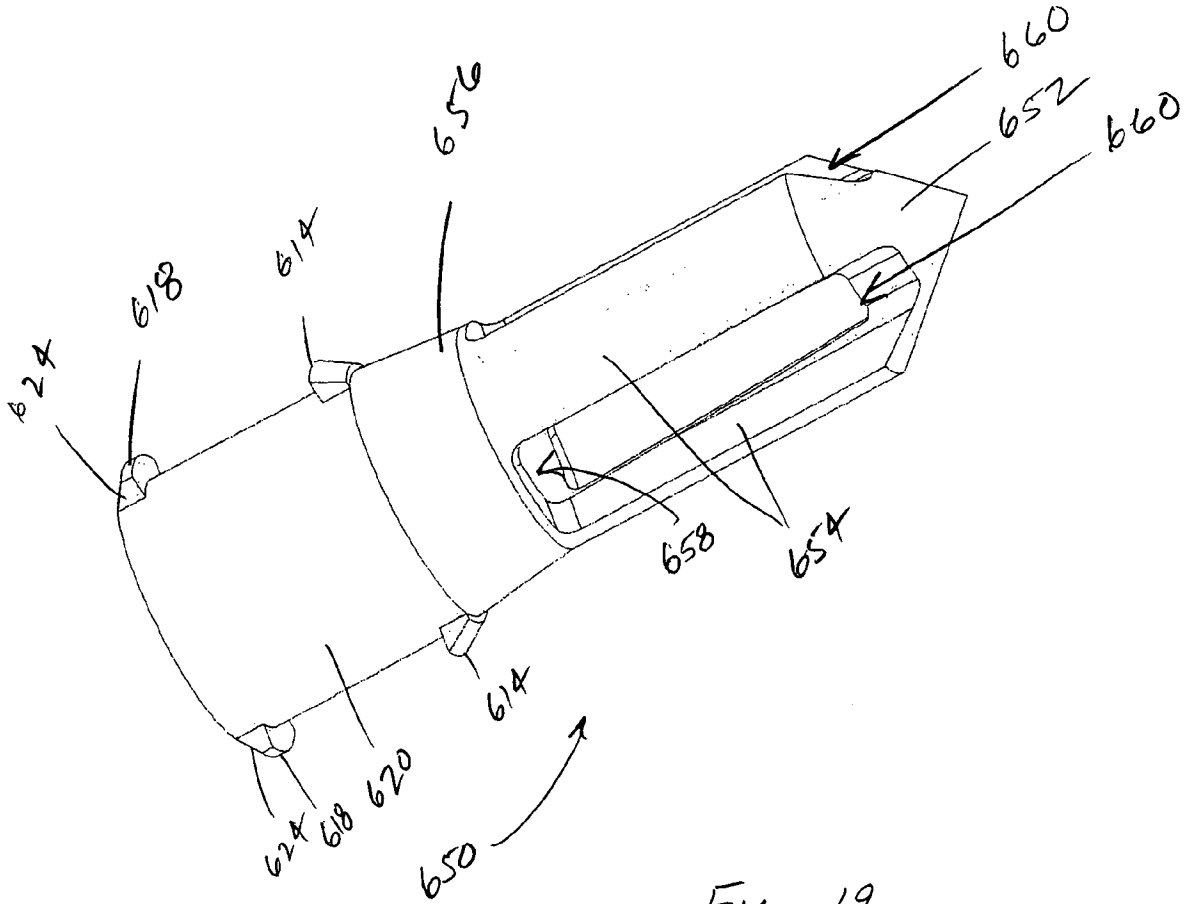
FIG. 19 is a perspective view of a piercing portion of the one-way valve assembly of the device of FIGS. 16 and 17.

Another difference of the device 610 in comparison to the devices 10 and 210 described above, is that the piercing portion 650 is a hybrid of the piercing portions 50 and 250 of devices 10 and 210, respectively. As shown in FIG. 19, the piercing portion 650 includes three intersecting members 654 creating three flow channels 660 (only two shown in FIG. 19). The three intersecting members 654 define a piercing surface 652 at one end and each joins to the base 656 at an opposite end. The flow channels are in fluid communication with the flow aperture 658 that in turn is in fluid communication with the second passageway 648. The base 656 of the piercing portion 650 resembles the base 56 in FIG. 6 except for the absence of separate wall portions 120. The base 656 includes a single cylindrical wall portion 620. The wall portion 620 also includes snap-fit tabs 614, 618 for snap-fit engagement and retention within the valve body 644 as described above with respect to device 10.

Figure 20:
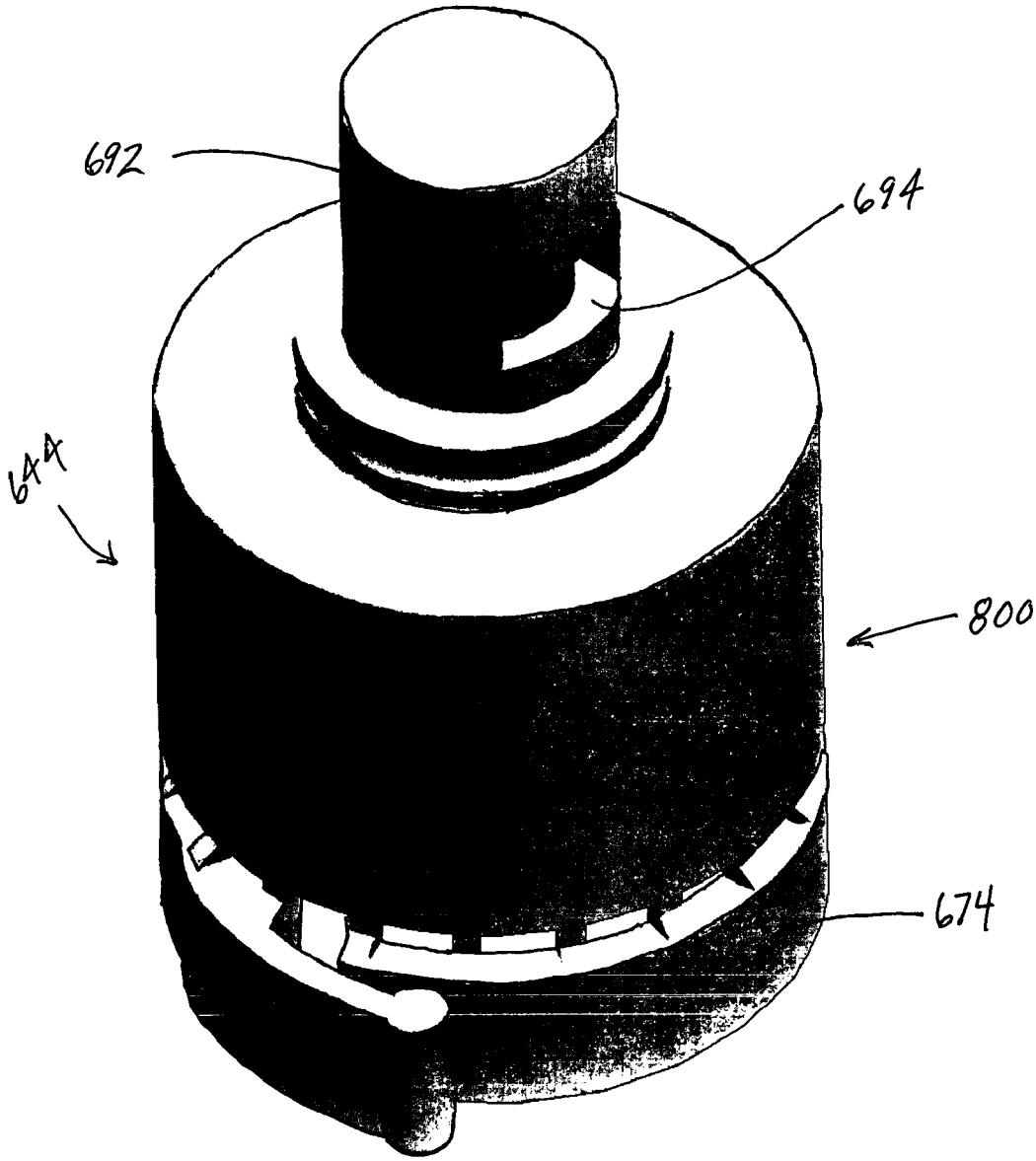
FIG. 20 is a perspective view of a valve body of the one-way valve assembly of the device of FIGS. 16 and 17.

Referring to FIG. 20, the valve body 644 is similar to the valve body 44 of FIG. 8. However, the grasping portion of the valve body 644 used to manually torque the valve body to the bushing 664 is defined by a smooth substantially cylindrical portion 800 that does not define any longitudinal ridges or grooves as in the above-described embodiment.

Figure 16:
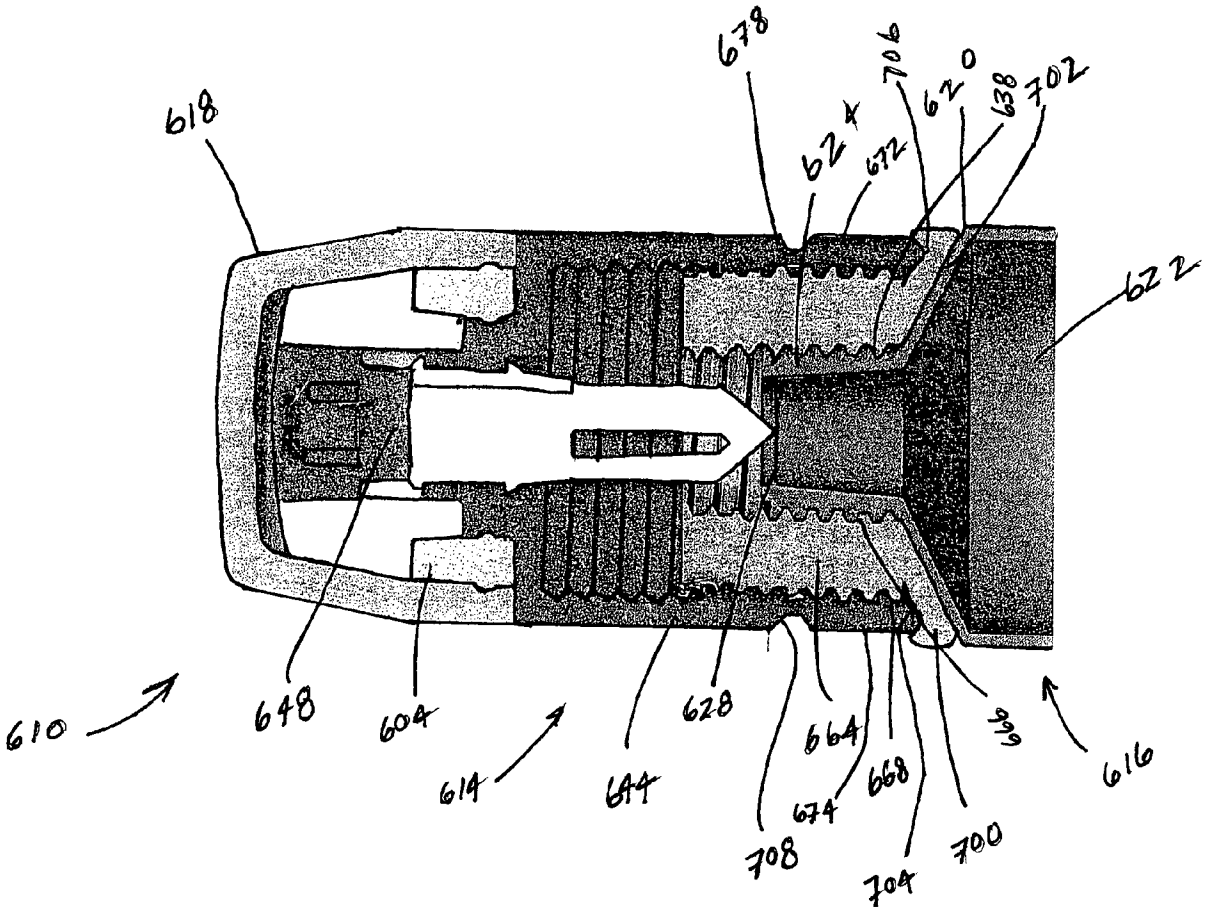
FIG. 16 is a cross-sectional view of another one-way valve assembly of a device including a container, a cap and one-way valve assembly that is connectable to the container for piercing the container and dispensing substances therefrom.
Figure 17:
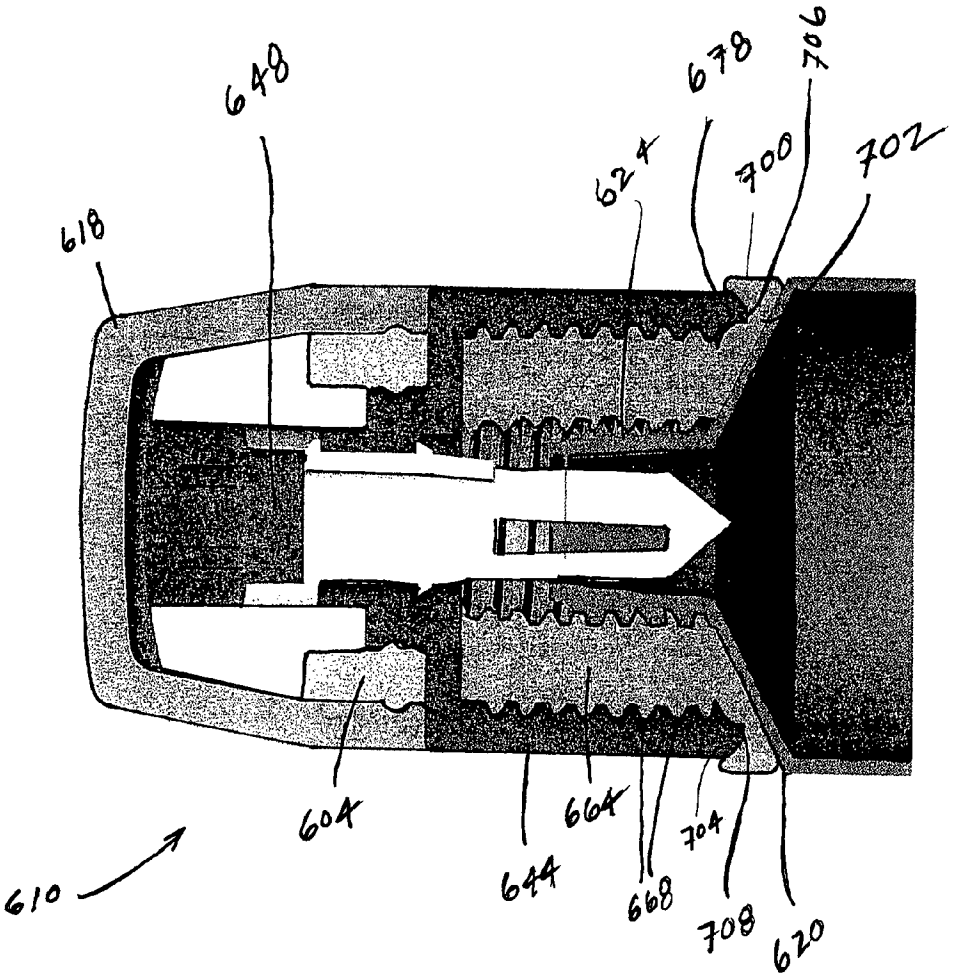
FIG. 17 is a cross-sectional view of the device of FIG. 16 illustrating the valve assembly with a frangible member removed and the valve assembly connected in fluid communication with the container for dispensing substances therefrom.

It will be recognized by one skilled in the pertinent art that a tamper resistant system may be employed with the device 610 of FIG. 16 to prevent and/or indicate whether the tube 16 covered by the valve assembly 14 has been tampered with. For example, a tamper resistant indicating tape located at a periphery of an interface between the tube 616, the base portion 700 of bushing 664 and the removable member 672 of the valve assembly 614 would indicate a possibility that the pierceable wall 628 or other underlying tube portion has been tampered with (e.g., pierced), without having to remove the valve assembly to visually inspect for the possibility of the same. In an alternative embodiment, and/or in addition to the tamper resistant indicating tape surrounding the interface between the tube 616 and the removable member 672 of the valve assembly 614, the internal threads 670 of the valve body 644 and external threads 668 of the bushing 664 may be configured to allow threaded rotation in one direction only, thus preventing separation of the valve body 644 from the bushing 664. For example, a pawl-type mechanism or ratchet wheel may be included that allows the valve body 644 to be torqued down onto the bushing 664 and substantially prevent rotation of at least one of the valve body 644 and/or bushing 664 when torque is applied in an opposite direction. In addition, the bushing 664 may be fixedly secured to the tube head after the bushing 664 is torqued down to the tube head. For example, an adhesive, other chemical bonding agent, or mechanical bonding means (e.g., heat staking) may be used to ensure that the bushing 664 can not be removed once it is installed on the tube head.

There are a number of advantages of the one-way valve assembly and container devices disclosed herein. By having the valve assembly separate from the container, the containers that have been used in the past to provide the various substances can continue to be used. Thus, for substances and containers that require regulatory approval for the containers, new approvals are not necessary. At most, the head of the container may be reshaped so as to be able to fit with the valve assembly. Alternatively, the bushing may be reshaped so as to be able to fit with both the valve assembly and head of the container. Accordingly, the same type of container can continue to be utilized and the valve assembly is added, which then limits the ingress of impurities or other contaminants into the container during and after dispensing while providing an improved application surface.

In addition, by adding the valve assembly, the substance can be dispensed more cleanly and with less waste. After dispensing, if necessary, the tip or application surface of the valve assembly may be wiped clean removing very little substance therefrom as waste. Furthermore, the remaining substance inside the container can remain free of impurities after the substance has been dispensed, since the remaining unused substance is separated by the one-way valve from the application surface. Accordingly, because the remaining bulk substance is substantially isolated from the application surface, it does not acquire any impurities from the object having the substance applied thereto, thus not affecting the integrity of the substance remaining in the dispenser or otherwise degrading the product between usages.

Another advantage of the present invention is that the device includes a piercing portion for piercing a pierceable wall sealing the product within the tube that does not need to be removed and does not waste product within the container after piercing the pierceable wall. Yet another advantage of the present invention is that the container may be essentially the same as the containers currently being used by drug or other manufacturers, thus obviating the need for time consuming and potentially costly studies of container stability during product shelf life. Another advantage of the present invention is that the device may define a relatively low valve opening pressure to dispense product from a flexible container via manually squeezing the container without the need for a mechanical pump or like actuator.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, the valve assembly and container device may include additional items or components. Additionally, the device could include a cap or like device that is fitted between the valve assembly and tube to pierce the tube and, in turn, connect the valve in fluid communication with the tube. In addition, the valve and container each may take any of numerous different configurations that are currently known or later become known. For example, the valve may define a different shaped valve seat and/or valve cover. In one example, the valve seat may define a taper such that the valve seat defines a progressively increasing diameter moving in the direction from the interior to the exterior of the valve to thereby progressively decrease the valve opening pressure in this direction. Additionally, the container need not be tube shaped, but rather may take a different shape and/or configuration, such as another squeezable body shape or rigid body shape having a pump or other means of propulsion of the substance from the storage area through the valve. Further, the covers may take any of numerous different configurations that are currently known or later become known. For example, each cover may include an annular protuberance on the inner side of the base wall of the cover that engages the adjacent end surface of the one-way valve cover when the container cover is closed to further prevent any undesirable seepage of substance through the valve if the tube is squeezed with the cover closed. Accordingly, this detailed description of the currently preferred embodiments is to be taken in an illustrative as opposed to a limiting sense. Therefore, it is intended that the invention not be limited to the particular embodiments disclosed for carrying out this invention, but that the invention will include all embodiments falling within the scope of the appended claims.

What is claimed is:

1. A device for storing and dispensing a substance, comprising:

a container comprising a body defining therein a storage chamber for receiving and storing the substance, a first axially-extending passageway that is in fluid communication with the storage chamber of the body and defines a flow path therebetween, a pierceable wall located on an opposite side of the passageway relative to the storage chamber, and a first connecting portion located at one end of the body for connecting another component thereto; and a one-way valve assembly comprising:

a valve body including a body base defining a second axially extending passageway internal to the valve body;

a piercing portion engageable with the pierceable wall of the container, wherein at least one of the piercing portion of the valve assembly and the pierceable wall of the container is movable relative to each other between a first position wherein the piercing portion is not piercing the pierceable wall, and a second position wherein the piercing portion is piercing the pierceable wall and the first passageway of the container is in fluid communication with the second passageway of the valve body for allowing flow of the substance from the storage chamber therethrough;

a second connecting portion that is connectable to the first connecting portion of the container for fixedly securing the valve assembly to the container when the valve assembly and container are located in the second position;

a manually engageable and removable member disposed intermediate the valve body and the container that is manually engageable and movable between a non-use position preventing movement of at least one of the piercing portion and pierceable wall to the second position, and a use position allowing movement of at least one of the piercing portion and pierceable wall into the second position;

a valve seat;

a valve cover including a cover base mounted on the body base and fixedly secured against axial movement relative thereto, and a valve portion overlying the valve seat;

and at least one flow aperture extending from the second axially-extending passageway and through the valve body to the exterior thereof adjacent to the valve seat and in fluid communication with the second passageway for receiving the substance from the storage chamber therethrough.

2. A device as defined in claim 1, wherein the piercing portion includes a piercing member defining a piercing surface at one end and joined to a base at an opposite end, the base having at least one fluid flow aperture for providing flow to the second passageway from the storage chamber.

3. A device as defined in claim 2, wherein the piercing member includes a plurality of intersecting members defining a plurality of flow channels along the intersecting members, each channel being in fluid communication with a fluid flow aperture in the base.

4. A device as defined in claim 1, wherein the valve portion is configured to move radially between a closed position with the valve portion engaging the valve seat, and an open position with at least a segment of the valve portion spaced radially away from the valve seat to allow passage of the substance therebetween.

5. A device as defined in claim 1, wherein the piercing portion has an axially-extending piercing surface that projects into the first passageway upon movement from the first to the second position.

6. A device as defined in claim 1, wherein at least one of the first and second connecting portions defines an annular raised threaded portion, and the other defines an annular recessed threaded portion for threadedly receiving therein the annular raised threaded portion to, in turn, fixedly connect one of the valve assembly and container to the other.

7. A device as defined in claim 6, wherein the removable member disposed intermediate the valve body and container allows threaded engagement with the container until the removable member makes contact with one of the container and the second connection portion defining the first position of the valve assembly and container, and removal of the removable member intermediate the valve body and container allows further threaded engagement between the valve assembly and container.

8. A device as defined in claim 1, wherein the removable member is frangibly connected to one end of the valve body, thereby adding to an axial length of the valve body and limiting axial translation of at least one of the valve assembly and container toward the other.

9. A device as defined in claim 1, further comprising a snap ring connected to the cover base to fixedly secure the valve cover to the valve body, the snap ring being configured for snap-fit engagement with the body base.

10. A device as defined in claim 1, wherein the second connecting portion includes a bushing to connect the valve assembly to the container.

11. A device as defined in claim 10, wherein the bushing extends beyond an end portion of the first connecting portion to expose additional threads in which to threadedly receive a threaded portion of the valve body.

12. A device as in claim 11, wherein the bushing includes internal threads to threadedly engage threads on the first connecting portion and external threads to threadedly engage the threaded portion of the valve body.

13. A device for storing and dispensing a substance comprising:

a container comprising a flexible body defining therein a storage chamber for receiving and storing the substance, a first axially-extending passageway that is coupled in fluid communication with the storage chamber of the flexible body and defines an axially-extending flow path therebetween, a pierceable wall located on an opposite side of the passageway relative to the storage chamber, and a first threaded connecting portion located at one end of the flexible body for connecting another component thereto; and a one-way valve assembly comprising:

a valve body including a body base defining a second axially-extending passageway internal to the valve body; a separate piercing portion connected to the valve body and engageable with the pierceable wall of the container, wherein at least one of the piercing portion of the valve assembly and the piercable wall of the container is movable relative to each other between a first position wherein the piercing portion is not piercing the pierceable wall, and a second position wherein the piercing portion is piercing the pierceable wall and the first passageway of the container is in fluid communication with the second passageway of the valve body for allowing flow of the substance from the storage chamber therethrough; a second threaded connecting portion that is connectable to the first threaded connecting portion of the container for fixedly securing the valve assembly to the container when the valve assembly and container are threadedly engaged with each other; an axially-extending valve seat; a valve cover formed of an elastic material and including a cover base mounted on the body base and fixedly secured against axial movement relative thereto, and a valve portion overlying the valve seat; and at least one flow aperture extending from the second axially-extending passageway and through the valve body to the exterior thereof and coupled in fluid communication with the second axially-extending passageway for receiving the substance from the storage chamber therethrough;

wherein the valve portion and the valve seat define a normally closed, annular, axially-extending valve opening therebetween, and the valve portion is movable radially between a normally closed position with the valve portion engaging the valve seat, and an open position with at least a segment of the valve portion spaced radially away from the valve seat to allow passage of the substance therebetween.

14. A device as defined in claim 13, wherein at least one of the first and second connecting portions defines an annular raised threaded portion, and the other defines an annular recessed threaded portion for threadedly receiving therein the annular raised threaded portion to, in turn, fixedly connect one of the valve assembly and container to the other.

15. A device for storing and dispensing a substance comprising:

first means for storing a substance and including a pierceable wall;

second means assembled to the first means for dispensing the substance and preventing the substance from flowing therethrough in an opposite direction;

third means disposed on the second means for piercing the pierceable wall; and fourth means for preventing the third means from piercing the pierceable wall until desired, wherein at least one of the first means and the second means is movable relative to the other between a first position in which the third means is not piercing the pierceable wall, and a second position in which the third means is piercing the pierceable wall and the first means and the second means are in fluid communication with each other, wherein the first means is a container comprising a body defining therein a storage chamber for receiving and storing the substance, a head located at one end of the body, and a container passageway that is in fluid communication with the storage chamber of the body and defines a flow path therebetween;

the second means is a one-way valve assembly comprising:

a valve body including a body base defining a valve passageway internal to the valve body;

a valve seat;

a valve cover including a cover base mounted on the body base and fixedly secured against axial movement relative thereto, and a valve portion overlying the valve seat;

and at least one flow aperture extending from the second axially-extending passageway and through the valve body to the exterior thereof adjacent to the valve seat and in fluid communication with the valve passageway for receiving the substance from the first means therethrough;

the third means is defined by a piercing portion engageable with the pierceable wall of the first means; and the fourth means is a frangible member disposed at the second means.

* * * * *